US006047404A

United States Patent [19]

Blanks, I

[11] Patent Number: 6,047,404

[45] Date of Patent: Apr. 11, 2000

[54] APPAREL HAVING INTERCHANGEABLE AND REVERSIBLE SECTIONS WHICH CAUSE ALTERATION THEREOF

[76] Inventor: Stevenson T. Blanks, I, c/o Rita Coleman, 1422 Pearce Park, Apt. 6, Erie, Pa. 16502

[21] Appl. No.: 08/889,372

[22] Filed: Jul. 8, 1997

Related U.S. Application Data

[60] Provisional application No. 60/021,341, Jul. 8, 1996.

[51] Int. Cl.[7] ..... A41B 1/00

[52] U.S. Cl. ..... 2/69; 2/108; 2/85; 2/94

[58] Field of Search ..... 2/69, 108, 85, 2/93, 94, 115, 227, 269, DIG. 2, 72, 74, 75, 105, 106; 24/381, 383, 382

[56] References Cited

U.S. PATENT DOCUMENTS

| | | | |
|---|---|---|---|
| 2,290,638 | 7/1942 | Englander | 2/70 |
| 4,099,301 | 7/1978 | Fujisaki | 24/386 |
| 4,347,629 | 9/1982 | Itoi | 2/108 |
| 4,944,042 | 7/1990 | DeWan | 2/94 |
| 5,029,344 | 7/1991 | Shannon et al. | 2/69 |
| 5,628,093 | 5/1997 | Goodale | 24/381 |

*Primary Examiner*—Gloria Hale

*Attorney, Agent, or Firm*—Jones, Tullar & Cooper, P.C.; Daniel A. Sullivan, Jr.

[57] ABSTRACT

An article of clothing has a section which can be detached, reversed (that is to say, turned inside out), and then re-attached. The section can have imprints on both its inside and its outside. The section is, for instance, an arm section or a waist section, with the detach-, re-attachability being provided by a zipper. Special zippers are provided to make the reversing ability possible.

14 Claims, 24 Drawing Sheets

36
12a
18h
28a
12a
14a
12a
6b
6a
12a
18a
IMPRINT
IMPRINT
IMPRINT
IMPRINT
18a
12a
12a
16a
IMPRINT
10a
IMPRINT
16a
8a
18a
12a
8b
IMPRINT
16a
10b

36
IMPRINT
12b
18h
28b
12b
12a
14b
6a
6a
12b
18a
IMPRINT
IMPRINT
IMPRINT
IMPRINT
18a
12b
12b
16b
IMPRINT
10a
IMPRINT
16b
8b
18a
8a
12b
IMPRINT
16b
10b

APPAREL HAVING INTERCHANGEABLE AND REVERSIBLE SECTIONS WHICH CAUSE ALTERATION THEREOF

The benefit of provisional application No. 60/021,341 filed Jul. 8, 1996 is claimed. Provisional application No. 60/021,341 filed Jul. 8, 1996 is incorporated herein by reference.

BACKGROUND OF THE INVENTION

1) Field of the Invention

The present invention has relevance to apparel, that can be manufactured, marketed, and sold, having interchangeable and reversible partial upper and lower sleeves, a waist section and a hood section, that would exhibit various colors and imprints on them that are outfitted with releasable affixing means.

2) Description of Related Art

Previously, as well as now, numerous pullover type articles of apparel such as coats, jackets, jerseys, sport shirts, and the like, were manufactured to be worn with customized imprints or imprinted patches having logos, insignias, messages, or visual illustrations of various sorts designed and made to meet one's preference. These desired designs and imprints, or imprinted patches, can be permanently placed on any of the above articles apparel on desired exterior sections by imprinting or sewing them directly on any suitable, selected section.

These previous art designs were and are limited in benefiting the manufacturer and consumer. To name one limitation, for example, suppose you purchase a coat, jacket, jersey, or sport shirt, which is custom-made to display the team logo of a particular team, which happens to be one of your favorites. Once you have purchased one of the above articles, that is all you get. You are limited to that particular article. Let's say you have five other favorite teams, which are in different leagues. If you desire to purchase one of the above articles to display the custom-made logos of your five favorite teams, this will result in you having to purchase five of the above articles. Purchasing five extra articles may be prohibitively costly for you and a waste of resources.

Yet another limitation is not being able to properly show your loyalty to all of your favorite causes or events because of inability or unwillingness to buy the requisite multiplicity of articles of apparel. It is well known that all true followers of favorite and noteworthy causes or events would like to display their loyalty to these causes or events via an article that is imprinted to depict these causes or events.

These limitations have caused others to discover and invent alternative methods whereby these limitations can be somewhat overcome, which will hereafter be briefly explained and described.

There are numerous inventive systems for removing and exchanging the sleeve sections of apparel. Examples of such are illustrated in the following U.S. PATENTS.

U.S. Pat. No. 2,122,873 (SHUSTER) shows a jacket construction in which an attaching means is concealed when the sleeves are attached. When the sleeves are removed a smooth surface is provided at the shoulder arm-pit portion of the jacket.

SHUSTER also shows in U.S. Pat. No. 2,677,131 a combination garment invention wherein the sleeves and adjoining sections of the body are made of one material and the remaining portion of the body is made of a different or contrasting material, thus creating the illusion of two separate garments being worn supposedly one upon the other, such as a shirt and vest, or shirt and slipover sweater. The garment has attaching means that will be flat and concealed from view when the side elements are secured to the balance of the garment, and also when the side elements are removed, so that a smooth and even surface will be apparent at all times around the points of joinder of the side elements to the main body element. The sleeves can also be interchanged by another set of sleeves.

JONES in U.S. Pat. No. 4,006,495 illustrate a coat construction having semi-detachable sleeves and pocket means for receiving such sleeves in their semi-detached condition. The user's arms can be removed from the sleeves while the coat is being worn, with the sleeves areas of the coat being storable in proximate storage areas provided interiorly of the coat.

SPITZ in U.S. Pat. No. 4,261,059 shows an inclement environment jacket and vest garment insulation-filled, having removably fastening sleeves, and retaining means for attaching the sleeves, when removed, to the inside of the jacket, thereby increasing the depth of insulation over substantial surface areas of the jacket. The retaining means may include fastening components constructed integrally with the removable sleeves.

Lastly, FITCHES IN U.S. Pat. No. 2,493,531, relates to garments, particularly shirts, dresses or other articles of wearing apparel to be improved. Variations in the appearance thereof, particularly changes in color, are obtained by the combining of sections in novel effects. This is accomplished by detachably connecting the sections of the garment, whereby a garment made of two sections, for instance, may have one section thereof replaced by another section of a different color, thereby causing novel and unusual effects in the garment.

SUMMARY OF THE INVENTION

Hereafter, it will be self-evident that objects and advantages of the present invention include the provision of pullover type articles of apparel such as jackets, coats, hockey jerseys, and the like having sections that can be easily interchanged and reversed. Overall, the effect is to alter the article's appearance, thereby creating novel effects in the articles.

For example, if the article is a jacket, the interchangeable and reversible section could include one or more of the following sections: partial lower sleeve sections, a partial lower waist section and a hood section.

These interchangeable and reversible sections, may exhibit imprints in the form of various colors and imprinted logos, insignias, names, messages, or visual illustrations on them, are outfitted with releasable affixing means, for instance a zipper type fasteners.

The term "imprints" is meant to include prints, as will as embroidery, patches, woven designs, and, any way of emplacing patterns, whether they be artistic (abstract or real), or graphic, patterns, or alphanumeric symbols.

Further objects and advantages of the present invention are realized by providing the articles of apparel and their interchangeable and reversible partial bottom sleeves and waist section bearing various colors and imprints with releasable fastening means. Because of this, the articles of apparel can be altered, thereby bringing about novel effects. The invention provides the capability of many versions and/or the subtilty of one version. In other words, for example, if you like a particular football team, and if the article of apparel is a winter type sports jacket, it would be designed and constructed so that it's wearer could display as many editions of your favorite football team logos as the wearer might wish. Or, let's say you also are a fan of hockey, basketball and baseball; you can have the left and right interchangeable and reversible partial lower sleeve sections of the jacket displaying the team logos of your favorite hockey and baseball teams, the interchangeable and reversible partial lower waist section displaying your favorite football team logos, and the interchangeable and reversible hood section displaying your favorite basketball team logos all at once or, if you wish, all coordinating the same team logo today, then interchanging or reversing all the interchangeable and reversible sections for a different edition of the same team logo tomorrow. Using teams logos is just one of the many infinite features of this invention. Any known sports-type team logo can be used to depict loyalty, or the invention may be used to fashion some type of nonverbal expression. This feature can range from pictures of movies, to friends or family, slogans, or any artistic, imprinted designs. Because of the designs and constructions of the present invention, the above articles of apparel will always remain fresh and never become out-dated, keeping pace with tomorrow's fashion trends and demands.

This feature would also cause an on-looking viewer to think that you have many versions of one of the above articles bearing imprints, when in reality you have only one article having interchangeable and reversible partial lower sleeve sections, a waist section and a hood section which cause alterations in the article's appearance.

A few overall results will be:

1) Lessening the need for buying articles of apparel every time old articles of apparel go out of style, thereby meeting and keeping up with the current fashion styles and demands.

2) Reducing the expense of articles of apparel bearing customized patches.

3) Reduce the cost of manufacturing articles of apparel.

4) Diminishing the need for retailers to carry limited articles of apparel bearing customized imprints or imprinted patches. Often, retailers are not sure of what articles of apparel bearing imprints or imprinted patches the consumer likes and wants to purchase. Overall, the retailer can be overstocked with unsold articles which the consumer doesn't want.

As it was stated above, the present invention is designed and constructed in a unique manner. The articles of apparel incorporate interchangeable and reversible, partial bottom sections bearing various colors and imprints on them. The articles utilize a releasable fastening means to bring about the interchangeability, reversibility and alterability. This will permit a user of the articles of apparel to implement the interchangeable and reversible partial lower sections with the articles of apparel for a purpose or event and to interchange and reverse those sections from the articles of apparel and install another array of sections within them.

Another object and advantage is to provide the articles of apparel with interchangeable and reversible partial lower sleeves, waist and a hood section displaying various colors and imprints. The partial lower sleeve sections, waist section and hood section of a winter-type sports jacket is designed and constructed with the capacity to be interchangeable and reversible. Each of the said sections bears custom-made imprints on two sides. This allows the sections to be not only interchangeable, but also reversible, and all one would have to do is turn the sections inside out, thereby producing reversibility which will in turn bring about alterations in the jacket. For example, if you are a fan of a particular basketball team, the jacket is designed and constructed so that you can wear as many editions of the logos of that team as you wish, by simply removing and then turning the interchangeable and reversible sections inside out, and, afterwards, affixing them back into place. Let's say you also like a particular football team. This feature likewise allows you to incorporate the logo of that team by having it's team logo imprinted on the opposite side of the said sections. Therefore, on one side of the sections would be your favorite basketball team logo and on the opposite side your favorite football team logo. This feature also causes an on-looking viewer to think that you have a variety of jackets bearing team logos on various sections, when in reality you have only one jacket which has the capacity to be altered.

Another important object of the present invention is to conceive designs and constructions in articles of apparel whereby the releasable affixing means on the main body and on the interchangeable and reversible sections are completely masqueraded from view. This gives the appearance that articles of apparel are integral articles, when, in reality, they have interchangeable and reversible sections incorporating into one foundation article.

These, and other objects and various aimed advantages of this present invention, will become unmistakably clear when reference is made to the following descriptions coupled, in association, with the accompanying drawings.

Thus, it will be seen that each of the examples of the invention concerns an article of clothing having a tubular section. The tubular section can, in each case, be detached, reversed (that is to say, turned inside out), and then re-attached at a tubular junction. Other than in the case of FIGS. 3 and 4, the detach-, re-attachability is preferably provided by a zipper using only two zipper tapes.

DETAILED DESCRIPTION OF THE DRAWINGS

Figure 1:
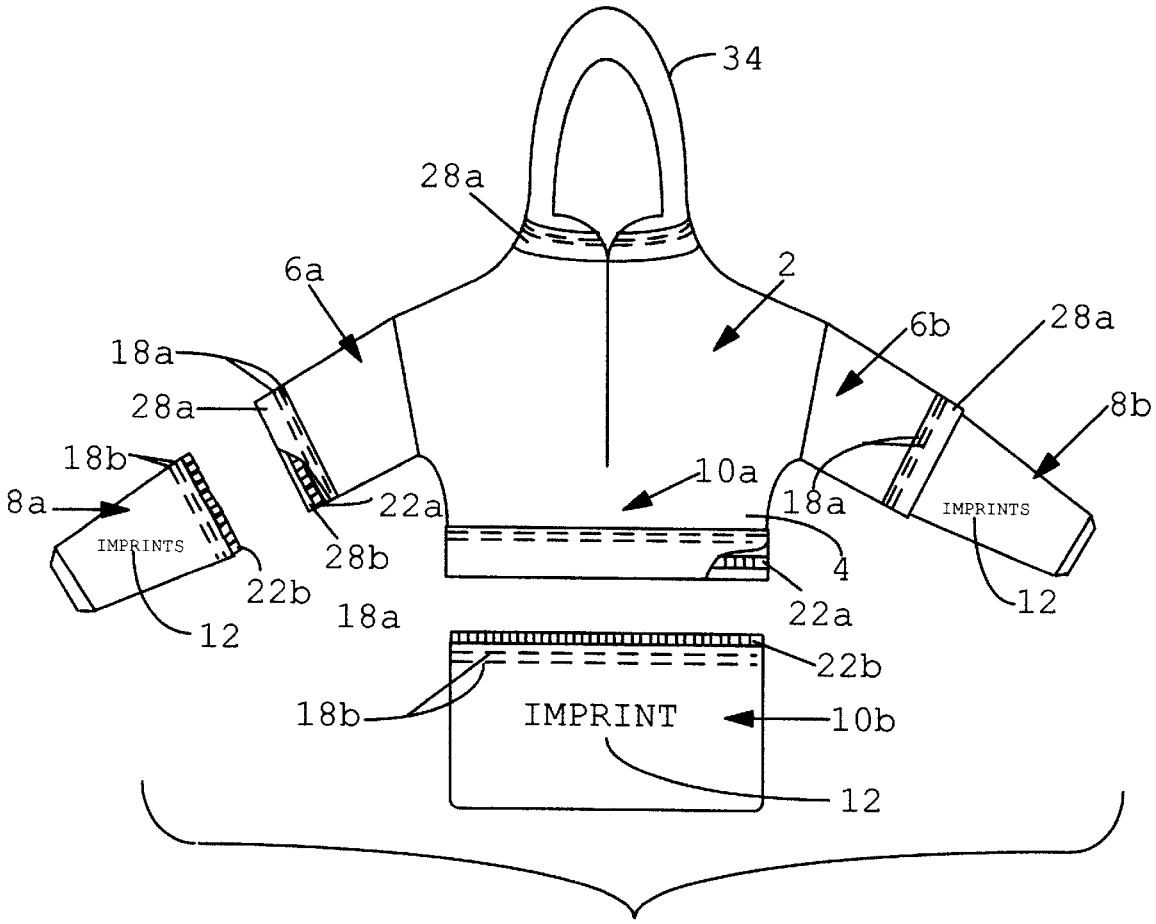
FIG. 1 is a front view of an article of apparel of the invention, in the form of a jacket, with one of the interchangeable and reversible partial bottom sleeve section and the waist section shown detached from the article's chief body component, partial upper sleeve and waist section.

Turning specifically now to the drawings, wherein like numerals denote like components, and first to FIG. 1, there is seen a front view of a article of apparel in the form of a jacket 2 composed of a chief body component 4 including two partial, upper sleeve sections 6*a* and 6*b*, and a partial, upper waist 10*a* section. The jacket also includes interchangeable and reversible, partial lower sleeve sections 8*a* and 8*b*, a partial lower waist section 10*b*, and a hood section 34, all bearing various colors and imprints.

Figure 2A:
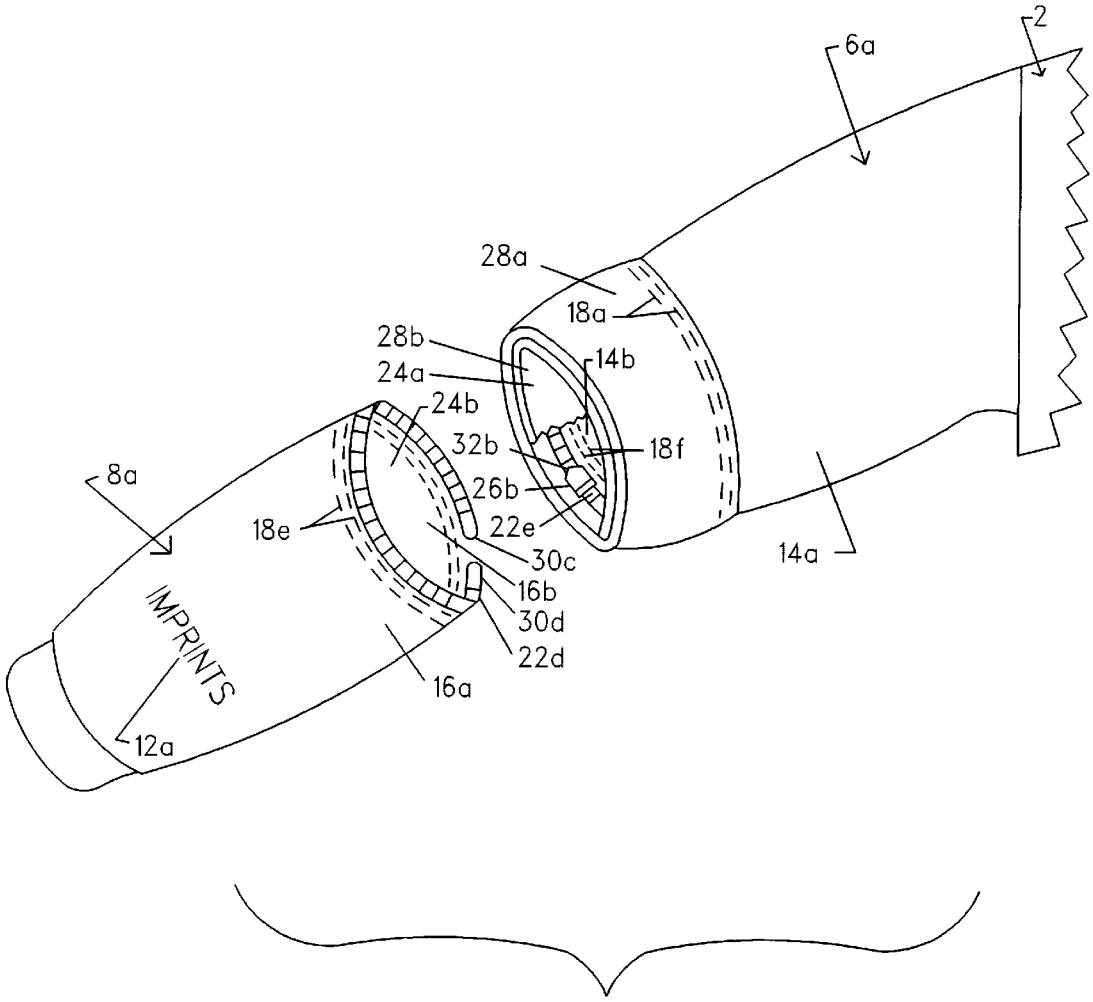
FIG. 2A is an enlarged view of the partial upper and lower left sleeve section of FIG. 1.
Figure 2B:
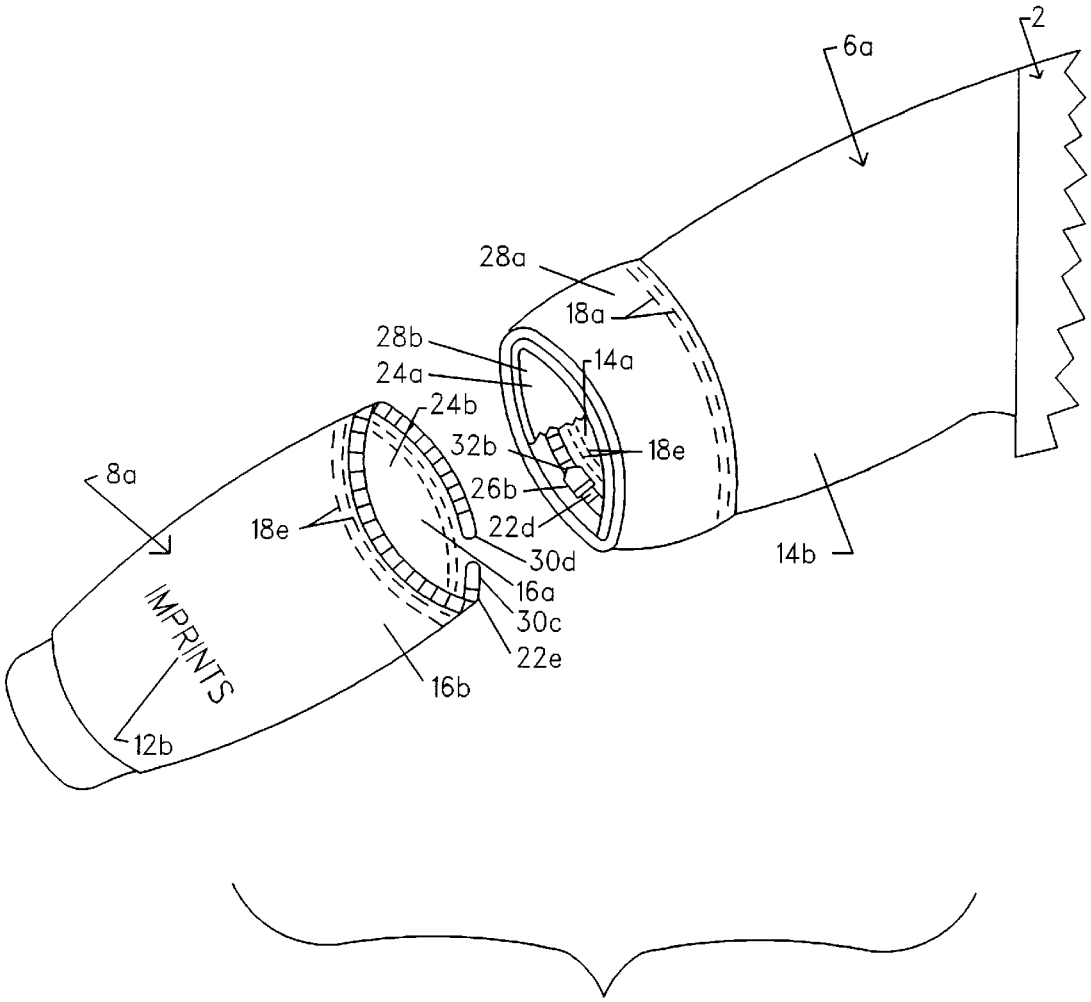
FIG. 2B is a view of FIG. 2A, reversed.
Figure 2C:
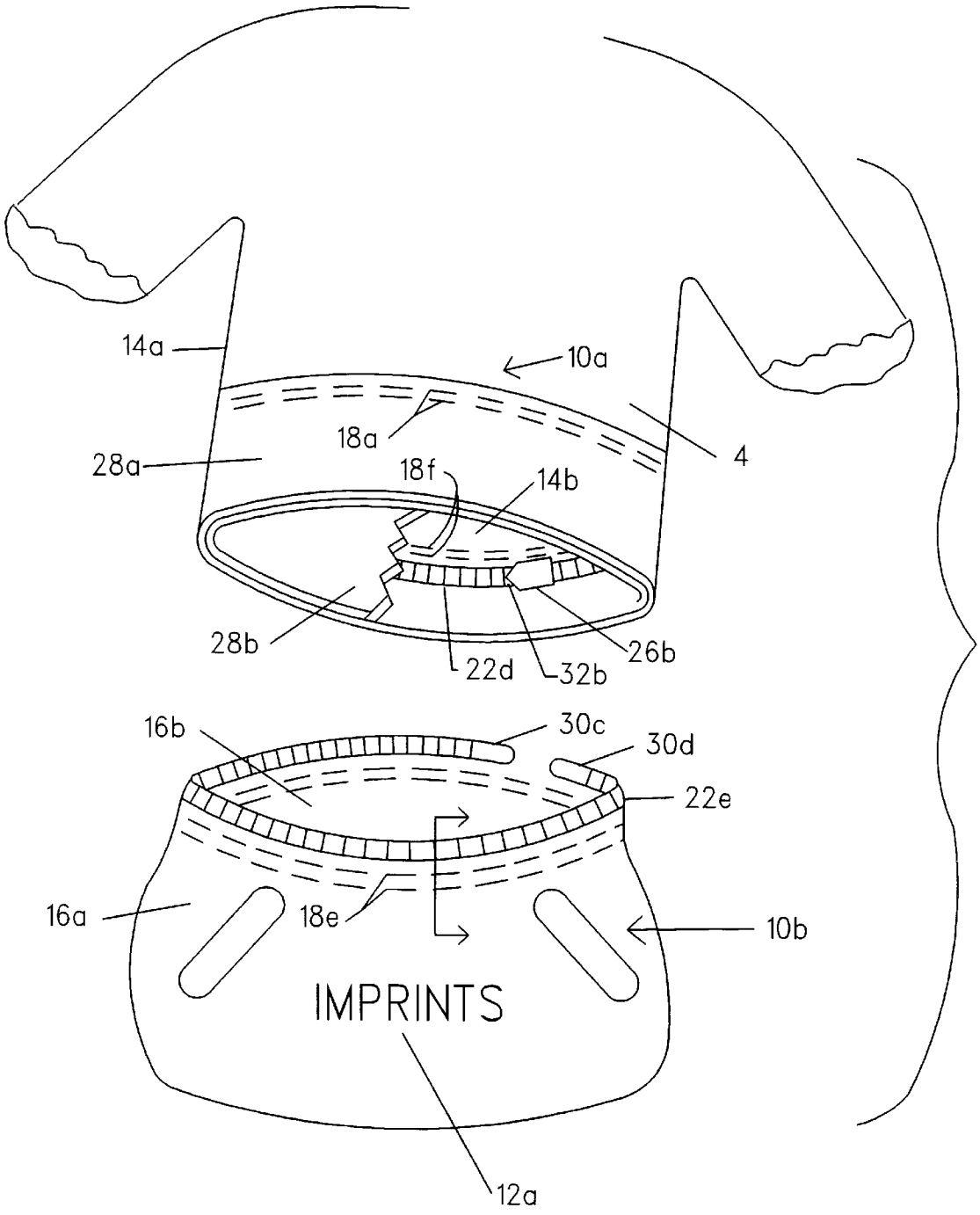
FIG. 2C is an enlarged view of the waist regional section of FIG. 1.
Figure 2D:
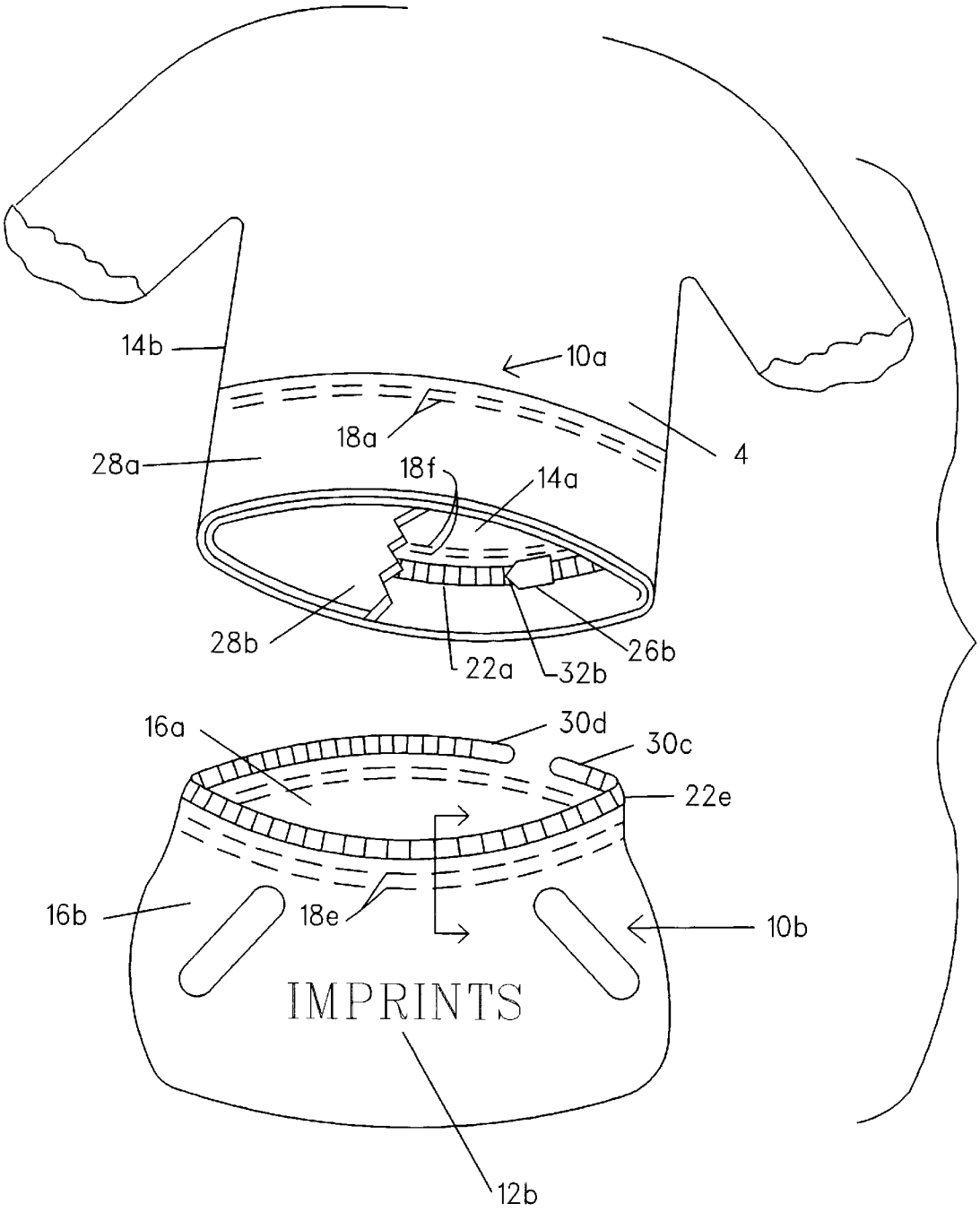
FIG. 2D is a view of FIG. 2C, reversed.
Figure 2E:
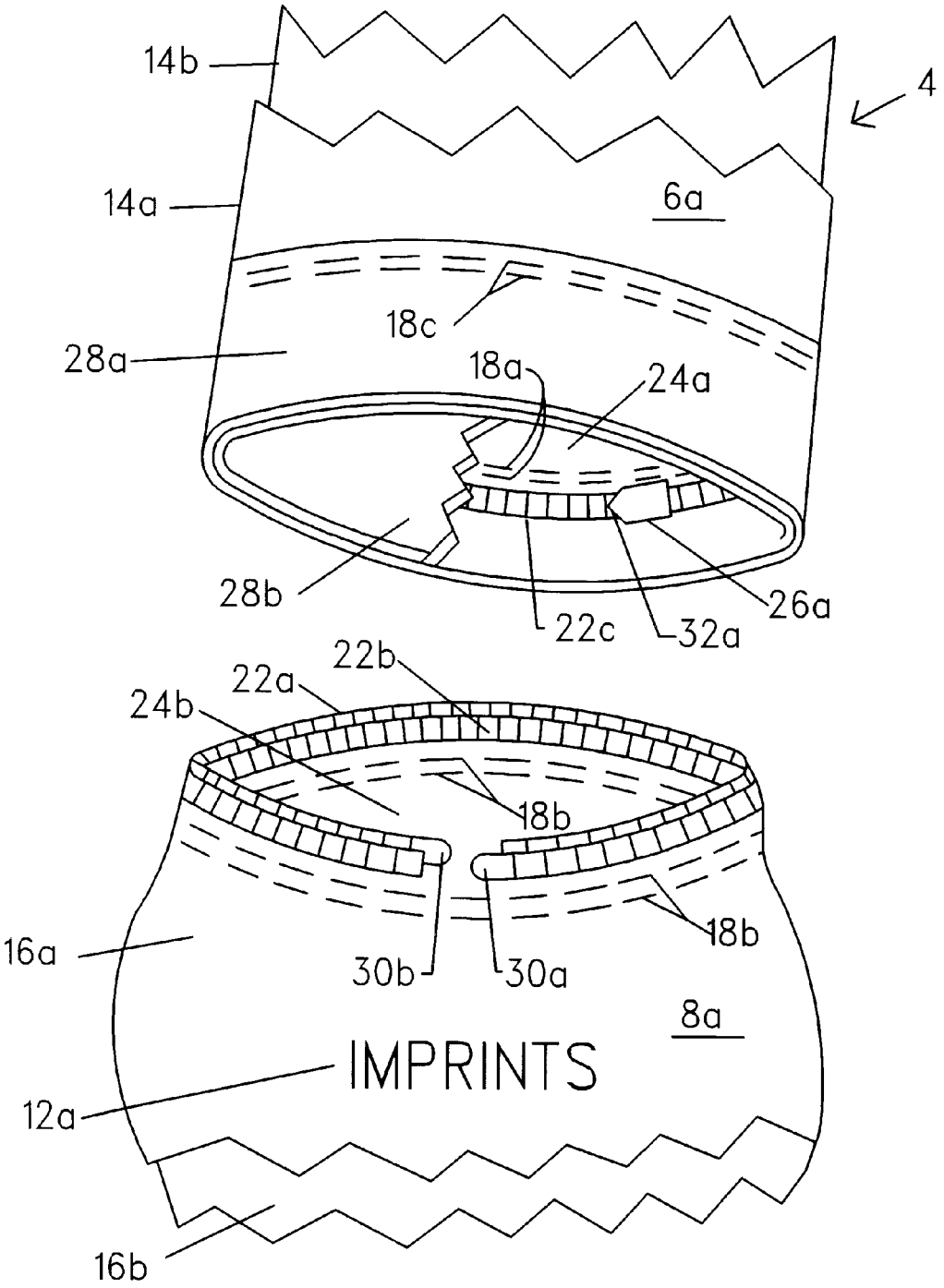
FIG. 2E is an enlarged fragmentary view of both the left partial upper sleeve section and lower sleeve section, and both the upper and lower waist regional section of FIG. 1.

FIG. 2E shows a fragmentary view of both the partial upper and lower sleeve sections 6*a* and 8*a* having materials 14*a*, 14*b*, 16*a* and 16*b* at the borderline portions of the said sleeve sections 6*a* and 8*a*, with hole opening sections 24*a* and 24*b*. As shown in the cross section of FIG. 4, the materials 14*a*, 14*b*, 16*a* and 16*b*, are, respectively creased upward and inward, and downward and inward afterwards, and affixed by double stitching 18*a* and 18*b*. The double stitching 18*a* and 18*b*, likewise pass through zipper tapes 20*a*, 20*b* and 20*c* in a circumferential manner after they are interposed between the creased materials 14*a*, 14*b*, 16*a* and 16*b* at their borderline portions on both the partial upper and lower hole opening sections 24*a* and 24*b*. Zipper tapes 20*a* and 20*b* possess specific sets, of unbroken lines, of fastening teeth members 22*a* and 22*b*, and male inserting members 30*a* and 30*b* at each of the ends of the tapes. Zipper tape 20*c* possess specific sets, of unbroken lines, of fastening teeth members 22*c*, a slide fastening member 26*a*, that carries a female receiving member 32*a*. The tooth edges on tapes 20*a*, 20*b* and 20*c* point outwardly from the creased materials 14*a*, 14*b*, 16*a* and 16*b* borderlines. The free ends of tapes 20*a*, 20*b* and 20*c* are set in between the creased materials 14*a*, 14*b*, 16*a* and 16*b* at the borderline portions of both partial upper and lower sleeve hole opening section 24*a* and 24*b* there is an unbroken line of fastening members 22*a*, 22*b* and 22*c*, encompassing the sleeve hole opening sections 24*a* and 24*b* on the creased borderline portions. This construction also applies to the partial upper and lower waist sections 10*a* and 10*b*.

FIG. 2E shows also the interchangeable and reversible partial lower sleeves section 8*a*, bearing various colors and imprints 12*a*, detached from the upper sleeve section of the chief body component 4. The receiver zipper tapes 20*a* and 20*b* of sleeve section 8*a* possesses fastening tooth members 22*a* and 22*b* affixed in such a way that the fastening tooth members 22*a* and 22*b* are pointed outwardly and farther out than the creased borderline material ends of the interchangeable and reversible partial lower sleeve section 8*a* and the ends of the zipper tapes 20*a* and 20*b* are affixed in adjoining and opposite directions (clockwise and counterclockwise) to each other at the lower borderline portion of both the partial lower sleeve section 8*a* and 8*b*, so that correct relationships are prepared for the sets of fastening tooth members 22*a* or 22*b* when adjoined to fastening tooth members 22*c* on the slide tape 20*c*. The same applies to the partial upper and lower waist sections 10*a* and 10*b*.

According to a noteworthy further development of the invention, when the partial lower interchangeable and reversible sleeve section 8*a* bearing colors and imprints 12*a* is correctly fastened to the chief body component 4 partial upper half sleeve section 6*a*, with the fastening tooth members 22*a* or 22*b* and 22*c* correctly connected, everything is totally hidden from being seen from either side, inside or outside, by overlapping flaps 28*a* and 28*b* (shown in cross section in FIG. 4), which, in turn, gives the article 2 (jacket) an appearance of being integral. This also applies to both the partial upper and lower interchangeable and reversible waist sections 10*a* and 10*b*.

Figure 4:
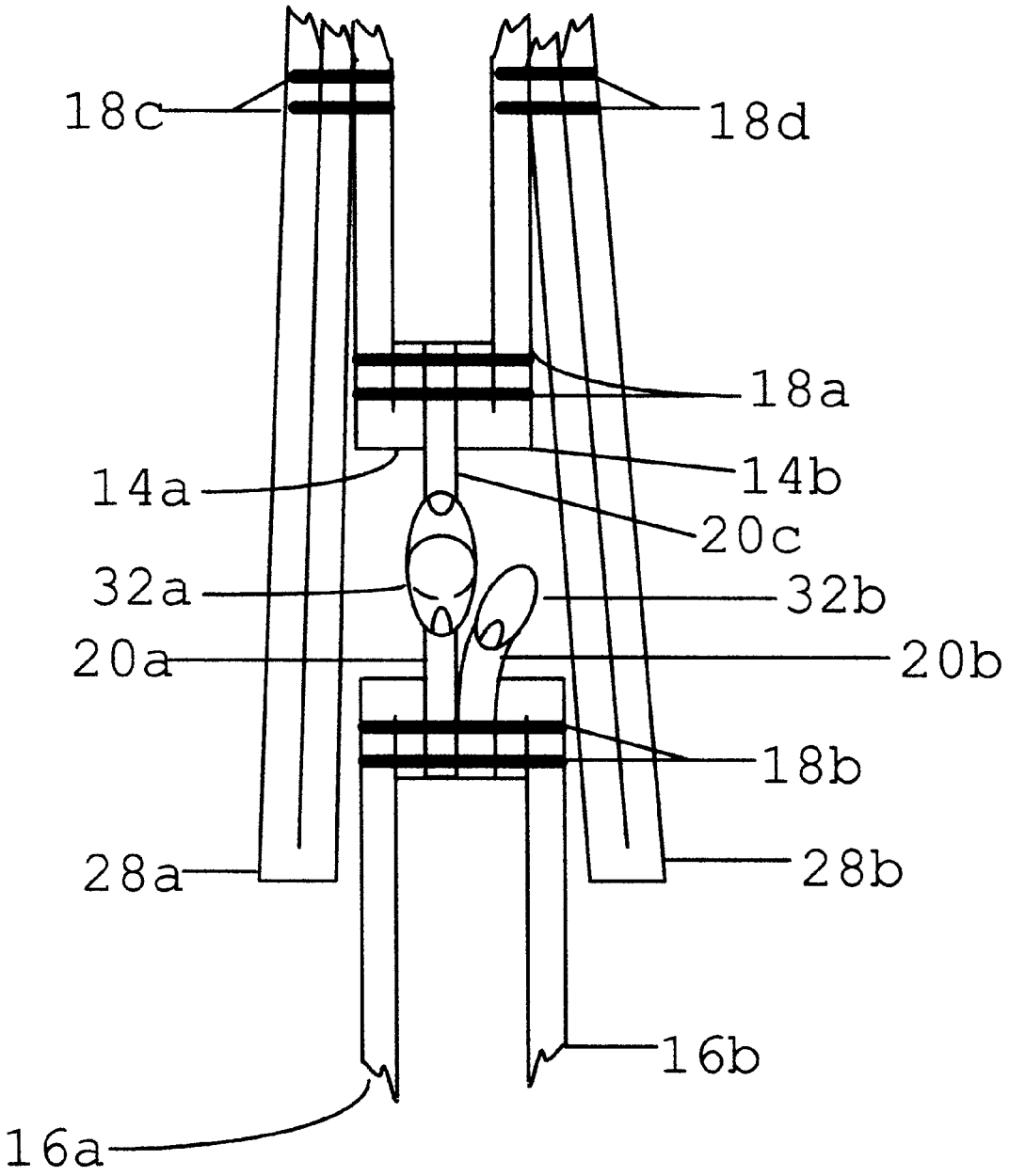
FIG. 4 is an enlarged cross-sectional view taken on lines 4—4 of FIG. 3.
Figure 5:
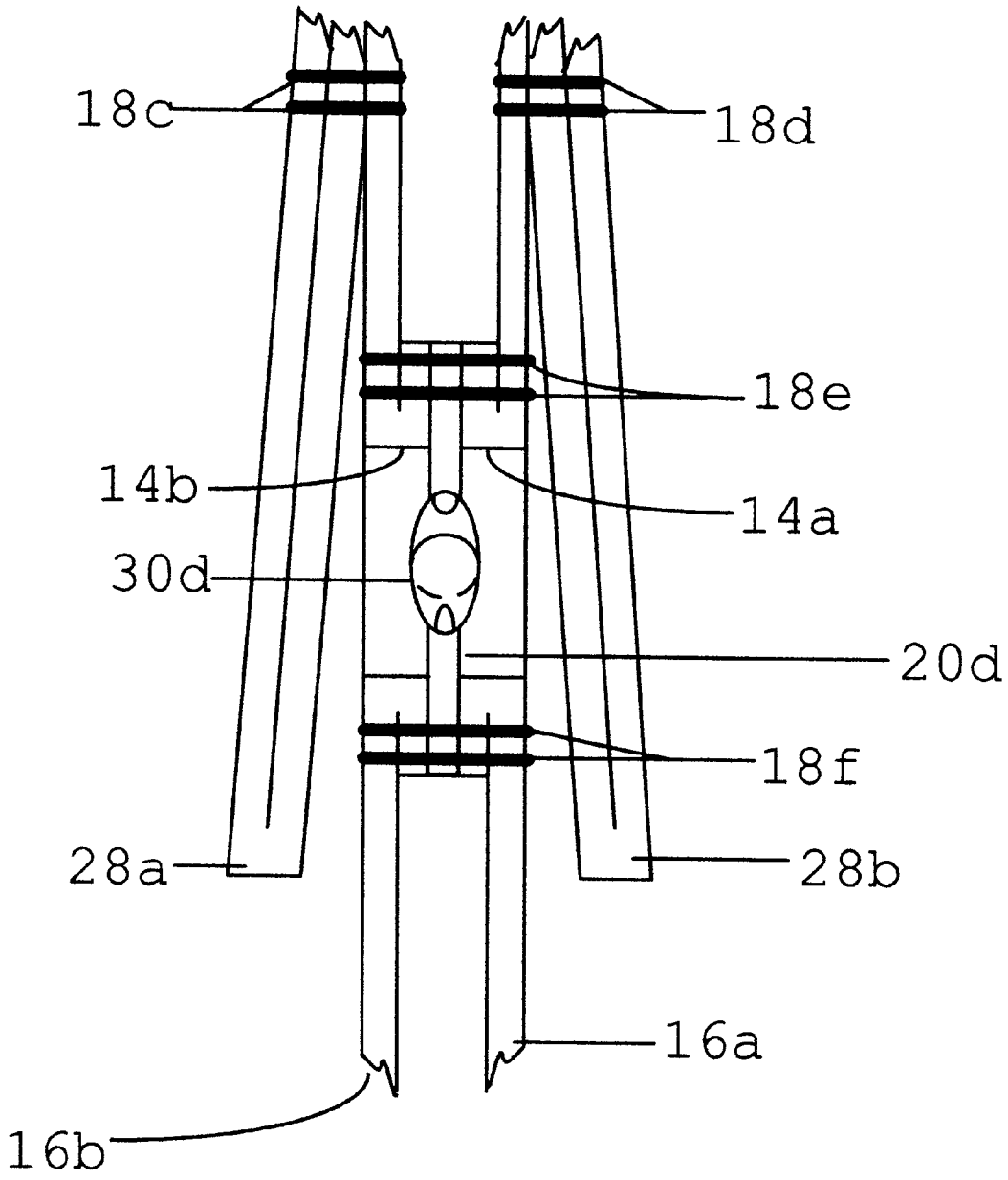
FIG. 5 is an enlarged cross-sectional view taken on lines 5—5 of FIG. 2M.

FIGS. 4 and 5 further exemplify the design and construction of the fastening means on the upper sleeve sections 6*a* and 6*b*, and also that on the interchangeable and reversible lower sleeve sections 8*a* and 8*b*. When the two are correctly fastened, the interchangeable and reversible partial lower sleeve sections 8*a* and 8*b* bearing imprints 12*a* are never in any danger of coming apart or being accidentally lost. This also applies to both the upper waist sections 10*a* and the interchangeable and reversible lower waist section 10*b*, bearing imprint 12*a* as in FIG. 1.

The flaps 28*a* and 28*b* as shown in FIGS. 2A, 3, 4 and 5 are added by setting and affixing them in place by double stitching 18*c* and 18*d* in a circumferential manner on a desired suitable location near the border of both the exterior and interior materials portions 14*a* and 14*b* of the partial upper sleeves sections 6*a* and 6*b*. The outer flap 28*a*, for instance, is utilized to hide the fastening tooth members 22*a*, 22*b* and 22*c* that are on the partial upper sleeve sections 6*a* and 6*b*, and on the interchangeable and reversible lower sleeve sections 8*a* and 8*b*.

The inner flap 28*b* is utilized to safeguard the skin, hair or clothing of the wearer from being harmed by the toothed edges of the connected fastening tooth members 22*a* or 22*b*, and 22*c* when the article (jacket) is worn. This also applies to the upper and lower waist section 10*a* and 10*b* of FIG. 1.

FIG. 1 show an interchangeable and reversible, partial lower waist section 10*b* being detached from the partial upper waist section 10*a* of the chief body component 4. The interchangeable and reversible waist section 10*b* may be designed and constructed in the same manner as the interchangeable and reversible partial lower sleeve section 8*a* mentioned above.

FIG. 2E demonstrates how to affix the interchangeable and reversible partial lower sleeve section 8*a* bearing colors and imprints 12*a* to the chief body component 4 partial upper sleeve sections 6*a*. Assembly of the sections 8*b* and 6*b* on the other side of the jacket may be done in the same way. The outside fastening means that has a male member 30*a* on it, is conveyed into the fastening means comprising the female receiving member of 32*a* on the slide fastening member 26*a*. The slide fastening member 26*a* is then pulled onward its full length of proceeding around the fastening members 22*a* and 22*c*, connecting them to one another and also at the same time affixing the interchangeable and reversible partial lower sleeve sections 8*a* bearing colors and imprints 12*a* to the partial upper sleeve sections 6*a* of the chief body component 4. When the slide fastening member 26*a* is pulled backward its complete length of proceeding around the fastening tooth members 22*a* and 22*c*, the interchangeable and reversible lower sleeve sections 8*b* is separated from the partial upper sleeve sections 6*a* and 6*b*, to be interchanged by another one or reversed, then connected back to the chief body component 4. The same applies to the partial upper waist section 10*a* and the partial interchangeable and reversible lower waist section 10*b* as in FIG. 1.

Figure 2F:
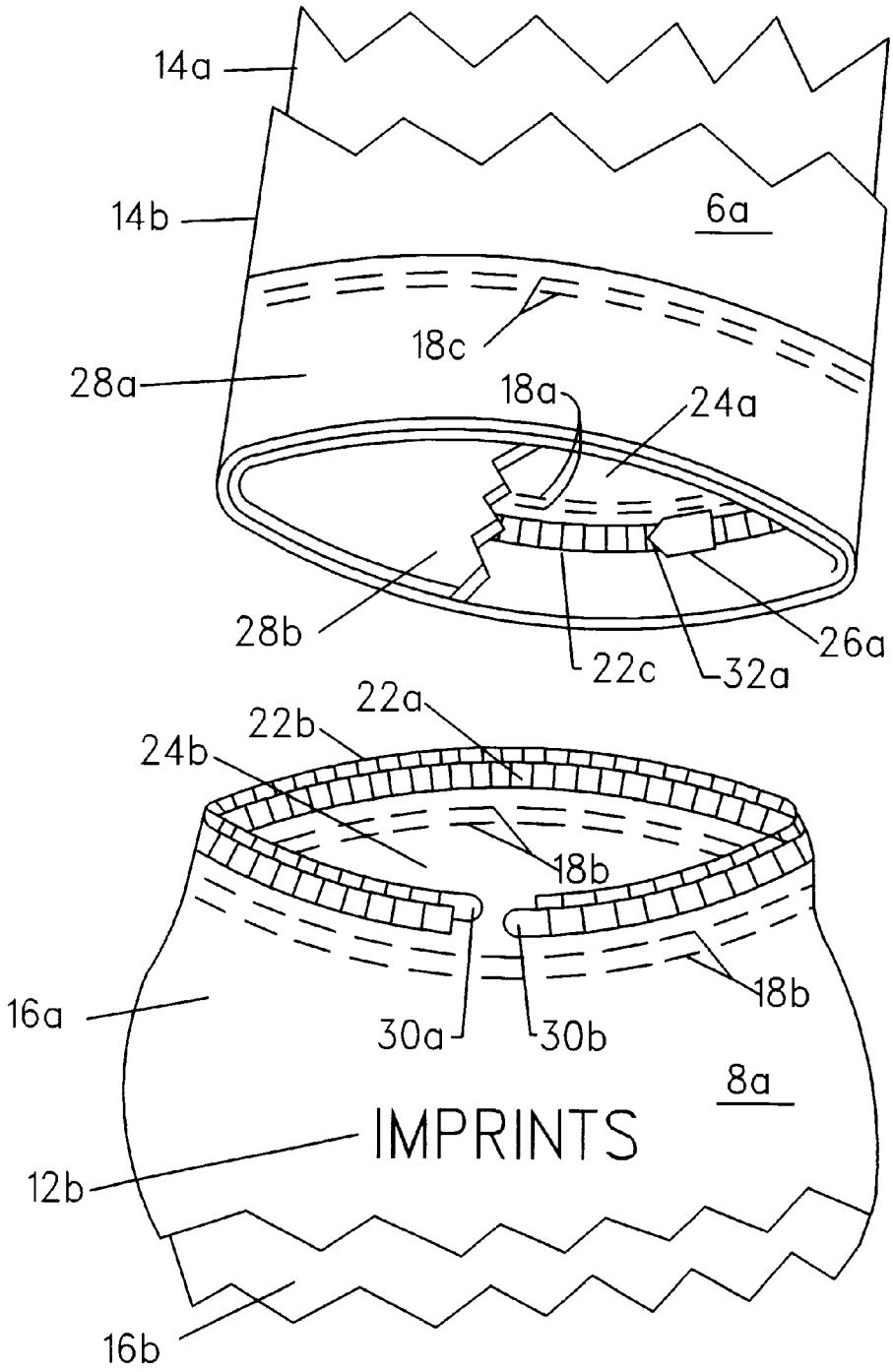
FIG. 2F is a view of FIG. 2E, reversed.

FIGS. 2E and 2F demonstrate further how the interchangeable and reversible partial lower sleeve section 8*a* is reversed, so that the inside imprint 12*b* is showing. To reverse the partial lower sleeve sections so that the imprint 12*b* is displayed, simply, turn the sleeve section 8*a* inside out. When sleeve section 8*a* is turned inside out, or reversed, it now displays imprint 12*b*. To affix the reversed sleeve section 8*a* onto the upper sleeve sections 6*a* on the chief body component 4, the fastening means that has the inserting male member 32*b* on it is conveyed into the fastening means that has a female receiving member 30*a*, of the slide fastening member 26*a*. The same applies to partial upper waist section 10*a*, and the interchangeable and reversible partial lower waist section 10*b*, as well as to sleeve section 8*b*.

Figure 2G:
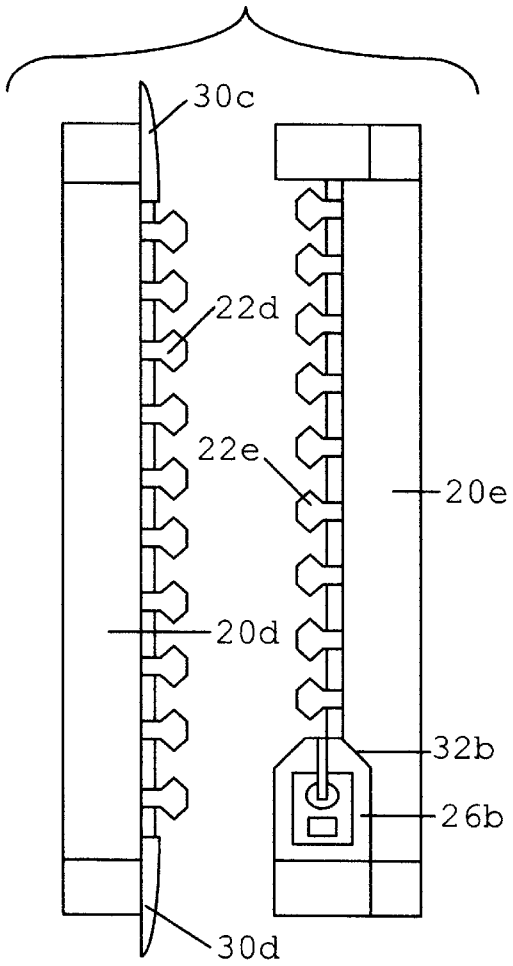
FIG. 2G is a view of a part of a two part separating zipper tape carrying male inserting members at both ends.

FIGS. 2A and 2B show an alternative method for designing and constructing the present invention, more specifically by providing fastening means for properly interchanging or reversing, and affixing the partial lower sleeve sections 8*a* and 8*b*, to the partial upper sleeve section 6*a* and 6*b*. As seen in FIG. 2G, receiver zipper tape 20*d* has symmetrical tooth members 22*d*, and two male inserting members 30*c* and 30*d* at each end, and slide zipper tape 20*e* carries symmetrical tooth members 22*d*, and a female receiving member 32*b* on a slide fastening member 26*b*. Zipper tape 20*d* is interposed between creased materials 16*a* and 16*b* on the partial lower sleeve section 8*a*, and zipper tape 20*e* is interposed between creased materials 14*a* and 14*b* on the partial upper sleeve section 6*a*. Afterwards, both are affixed with double stitching 18*e* and 18*f* in a circumferential manner as shown. The partial lower sleeve section 8*a* is now capable of being either interchanged, or reversed, afterwards affixed onto the partial upper sleeve section 6*a* by correctly connecting the symmetrical tooth fastening members 22*d* and 22*e* together. The same applies to the partial upper waist section 10*a* and the partial interchangeable and reversible lower waist section 10*b* bearing imprint 12*a* as seen in FIG. 2C, as well as to sections 6*a* and 8*b* on the other side of the jacket.

The separating zipper with tapes 20*d* and 20*e* with symmetrical teeth members 22*d* and 22*e*, and two male inserting members 30*c* and 30*d* at each end, and a slide fastening member 26*b* with a female receiving member 32*b* (FIG. 2G), is used in the development of the invention, so that the slide fastening member 26*b* is able to slide on and closed in either direction, and so that the partial interchangeable and reversible lower sleeve sections 8*a* and 8*b* bearing imprints 12*a* and 12*b* on the outside and inside is properly shown and reversed. As for an example, when the lower sleeve sections with imprint 12*b* is to be seen, simply reverse a lower sleeve section by turning it inside out so that imprint 12*b* is showing (FIG. 2B). Inserting male member 30*d* is conveyed into the female receiving member 32*b* on the slide fastening member 26*b* to fasten the partial lower sleeve section 8*a*, showing imprint 12*b*, to the partial upper sleeve section 6*a*. In order to display imprint 12*a*, remove the partial lower sleeve section 8*a* from the partial upper sleeve sections 6*a* and 6*b* afterwards, reverse the sleeve sections 8*a* and 8*b* by turning it inside out, so that imprint 12*a* is displayed. Inserting male member 30*c* is then conveyed into the female receiving member 32*b* on the slide member 26*a* to fastened the partial lower sleeve section 8*a*, showing imprint 12*a* onto the partial upper sleeve section 6*a* as seen in FIG. 2A. This development also applies to the partial lower and upper waist sections 10*a* and 10*b* bearing imprints 12*a* and 12*b* as shown in FIGS. 2C and 2D, as well as to sections 6*a* and 8*b* on the other side of the jacket.

Figure 2H:
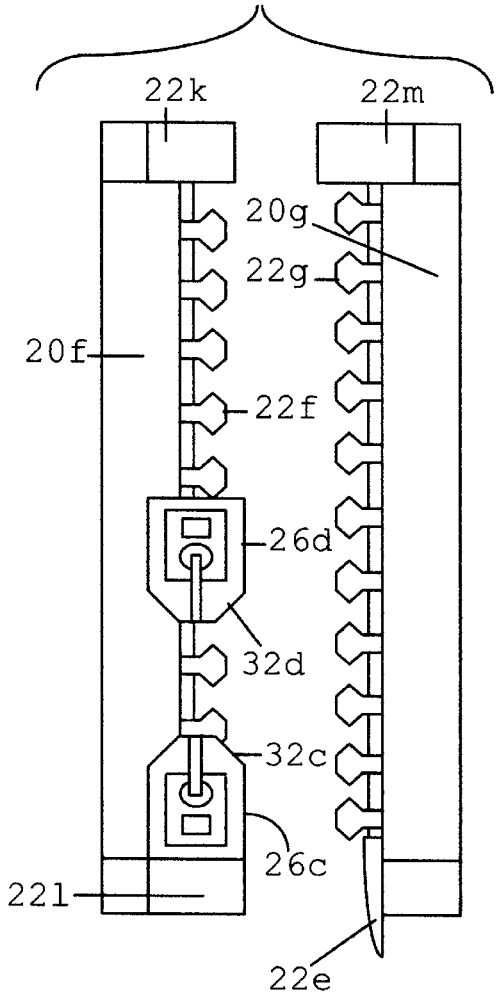
FIG. 2H is a view of a part of a two part separating zipper tape carrying two slide members with female receiving members.
Figure 2I:
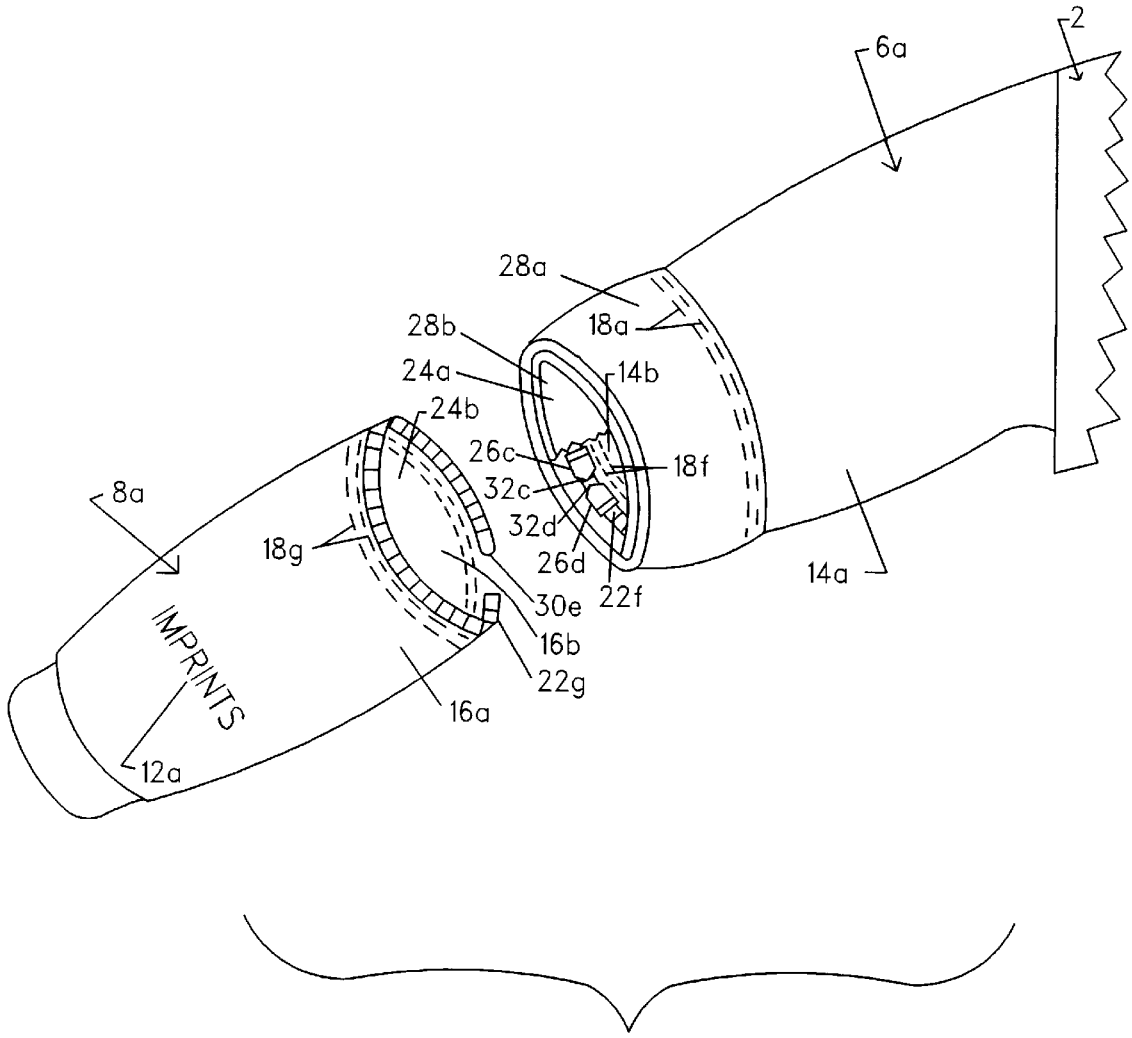
FIG. 2I is an enlarged view of the partial upper and lower left sleeve section of FIG. 1
Figure 2J:
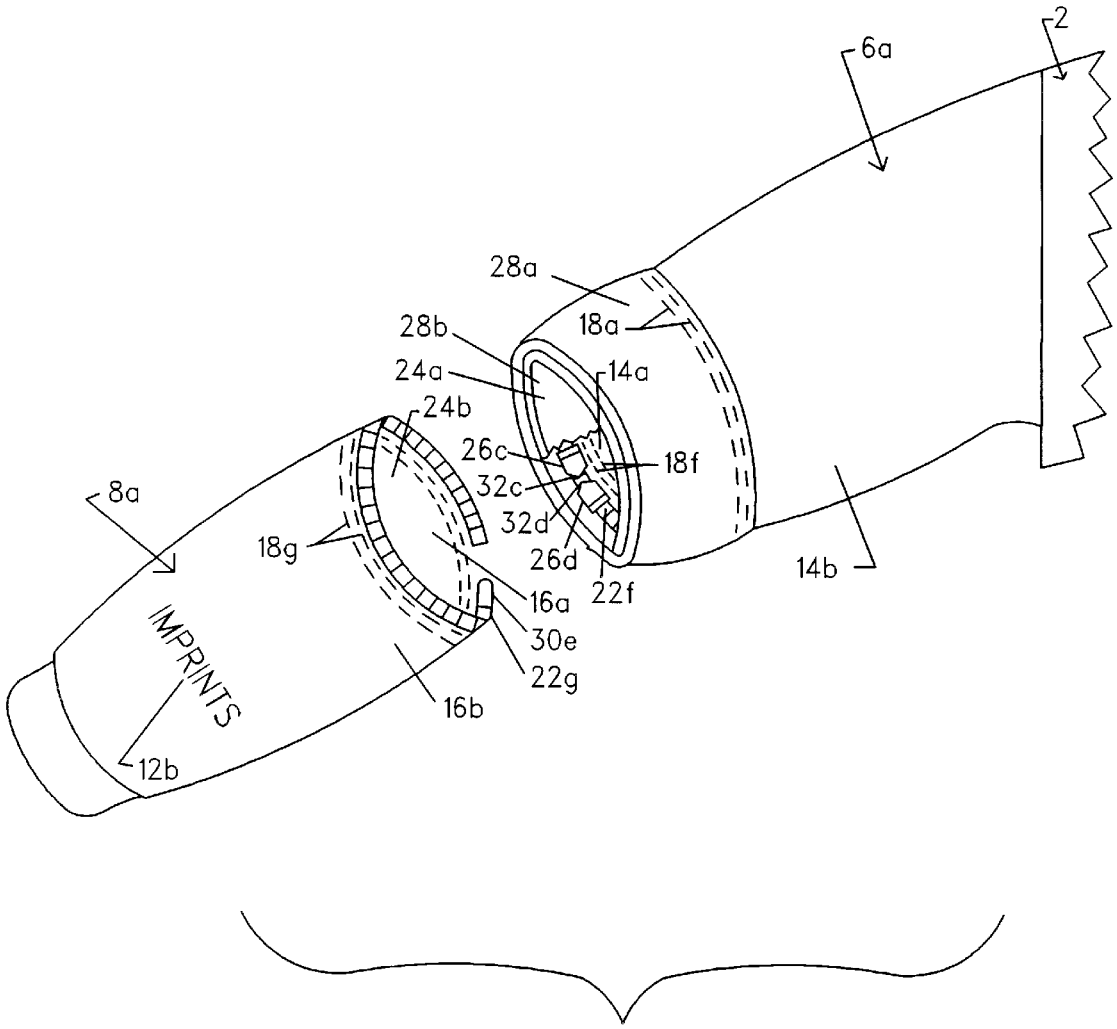
FIG. 2J is a view of FIG. 2I, reversed.
Figure 2K:
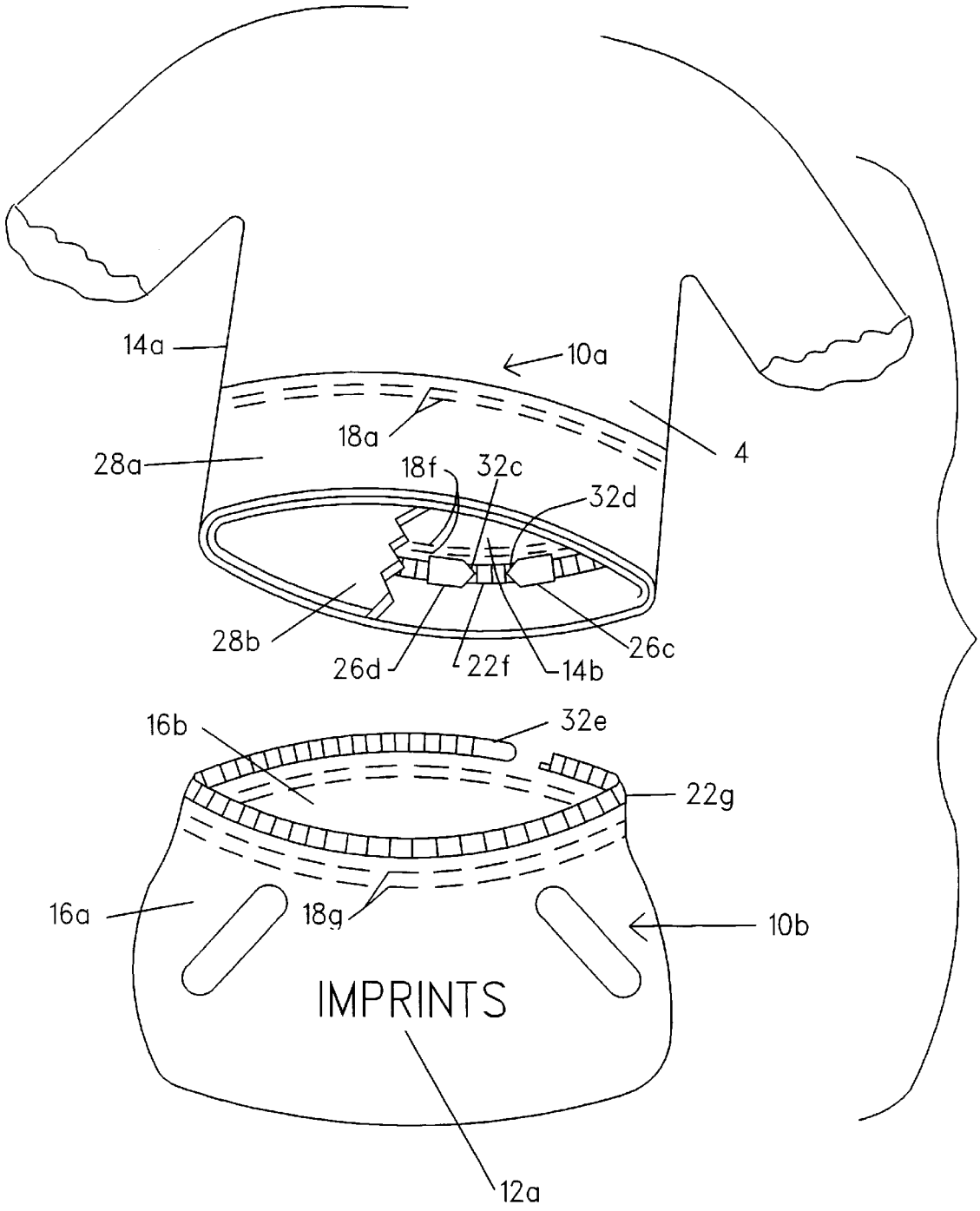
FIG. 2K is an enlarged view of the partial upper and lower waist section of FIG. 1.
Figure 2L:
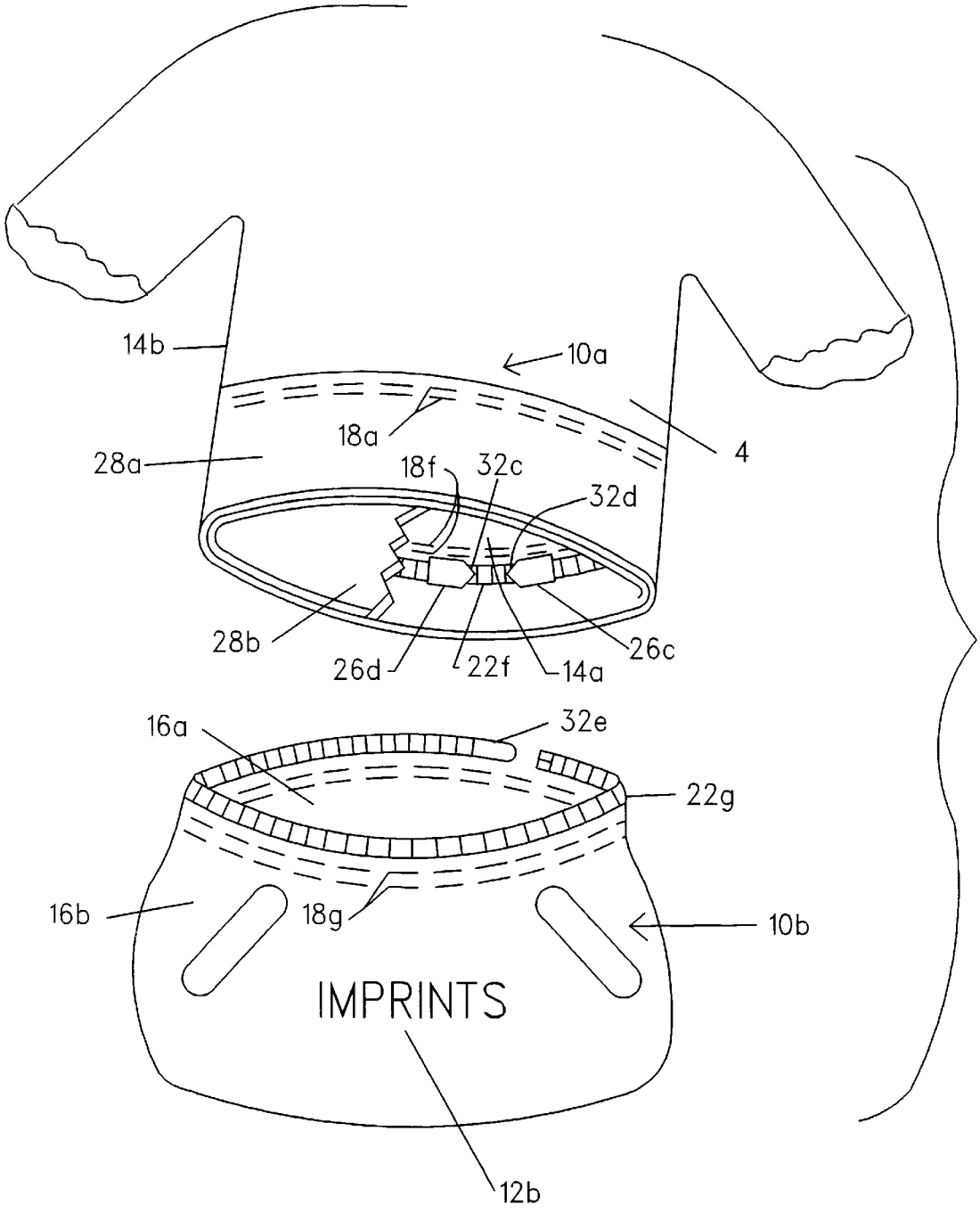
FIG. 2L is a view of FIG. 2K, of the sections being reversed.
Figure 2M:
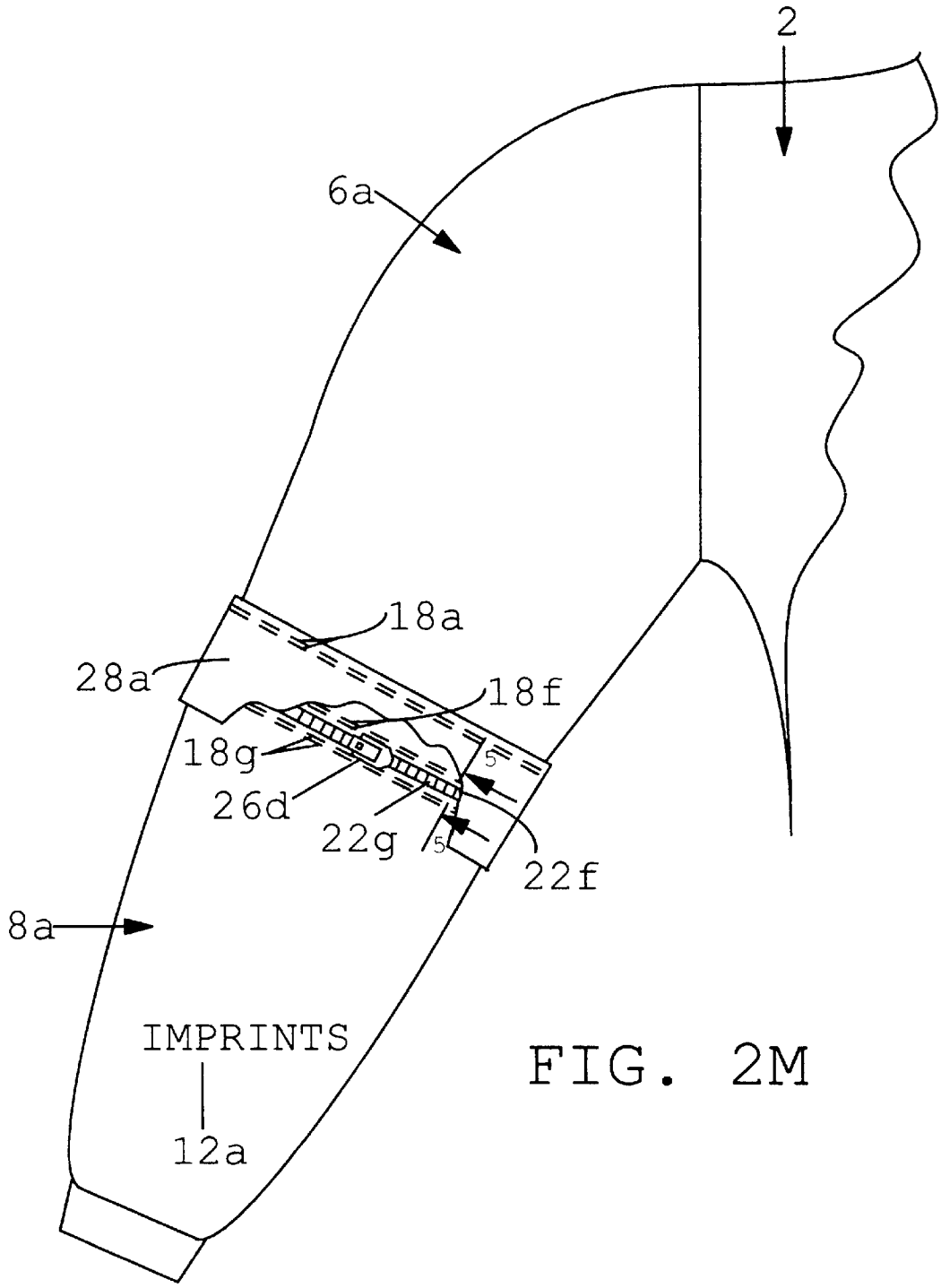
FIG. 2M is an enlarged view of an assembled left side of FIG. 1, with a portion broken away to display outfitting of fastening means
Figure 3:
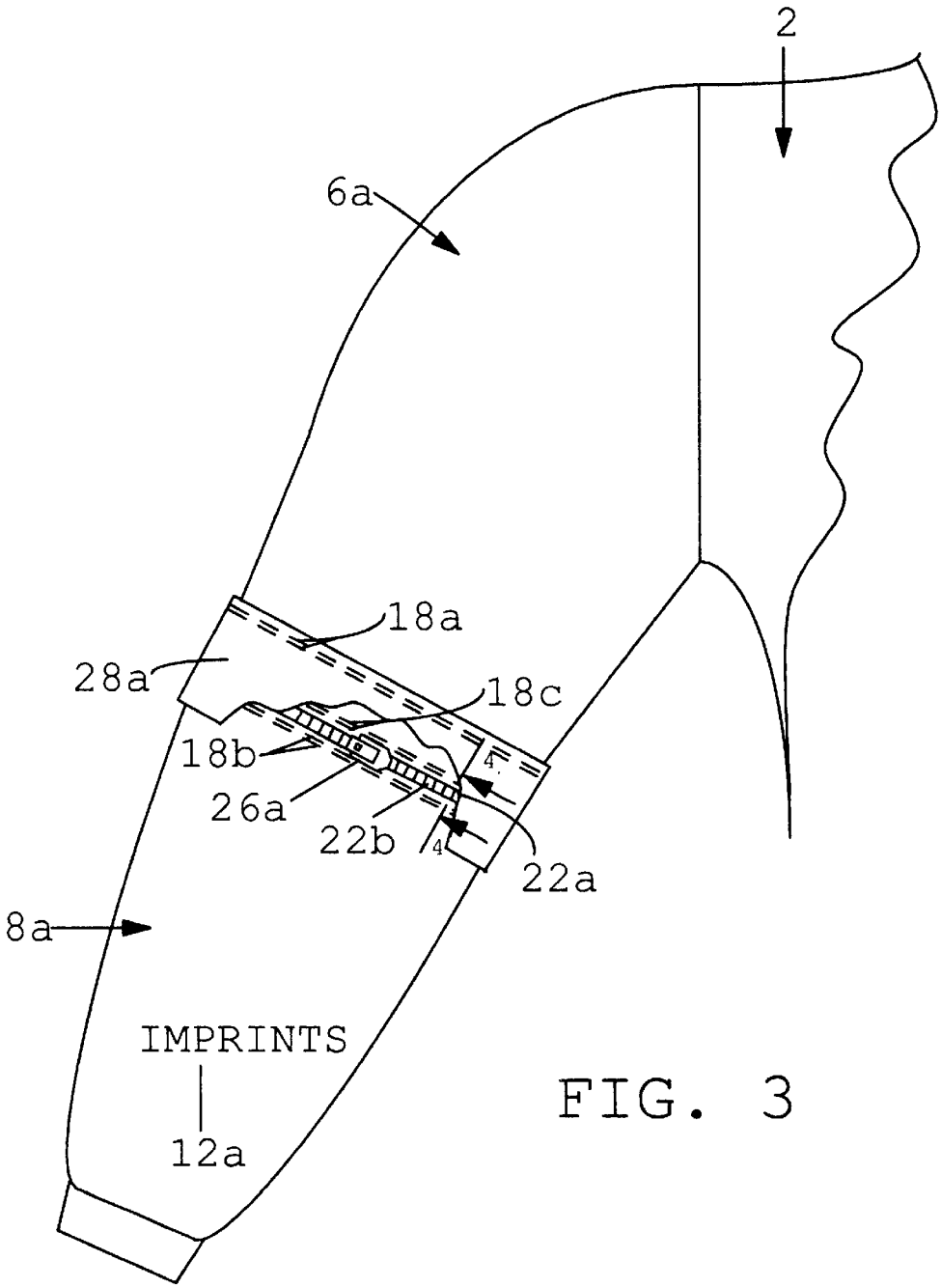
FIG. 3 is an enlarged view of an assembled left side of FIG. 1, with a portion broken away to display outfitting of fastening means.

FIGS. 2I and 2J show another method for designing and constructing the present invention, more specifically by providing fastening means for properly interchanging or reversing, and affixing the partial lower sleeve section 8*a* to the upper sleeve section 6*a*. As seen in FIG. 2H, slider zipper tape 20*f* possesses a specific set of fastening tooth members 22*f*, two female receiving members 32*c* and 32*d* on two slide fastening members 26*c* and 26*d*, directly facing each other as shown, and top and bottom stops 22*k* and 22*l*. Receiver zipper tape 20*g* carries fastening tooth members 22*g*, a male inserting member 22*e* at the bottom end, and a top stop 22*m* at the top end. Zipper tape 20*f* is interposed between creased materials 14*a* and 14*b* of the partial upper sleeve section 8*a*, and zipper tape 20*g* is interposed between creased materials 16*a* and 16*b* of the partial lower sleeve section 8*a*. Afterwards, both zipper tapes 20*f* and 20*g* are affixed with double stitching 18*f* and 18*g* in a circumferential manner. The partial upper sleeve section 6*a* is now capable of receiving an interchangeable and reversible partial sleeve section 8*a*, that is either interchanged, or reversed afterwards, affixed onto the partial upper sleeve section 6*a* by correctly connecting the fastening tooth members 22*f* and 22*g* together. To reverse the partial lower sleeve section 8*a*, so that imprint 12*b* that is on the inside is displayed outside, simply turn it inside out, afterwards, affixing it onto the partial upper sleeve section 6*a* (FIG. 2J). To display imprint 12*a* that is now on the inside of the partial lower sleeve section 8*a* outside, simply remove it from the partial upper sleeve section 6*a*, reverse them by turning them inside out, afterwards, affixing it back onto the partial upper sleeve section 6*a* (FIG. 2I). The same applies to the partial upper waist section 10*a* and the partial interchangeable and reversible lower waist section 10*b* bearing imprint 12*a* as seen in FIGS. 2K and 2L, as well as to sections 6*a* and 8*b* on the other side of the jacket.

Figure 6A:
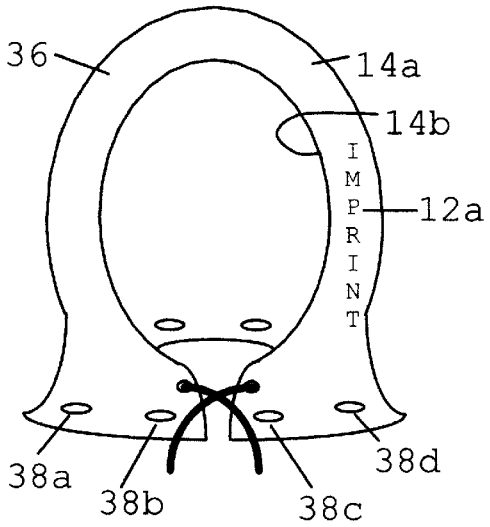
FIG. 6A is a view of the interchangeable and reversible hood section, with button holes.
Figure 6B:
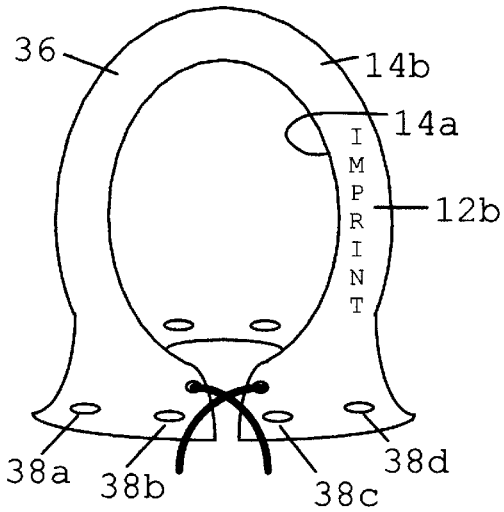
FIG. 6B is a view of FIG. 6A, reversed.
Figure 6D:
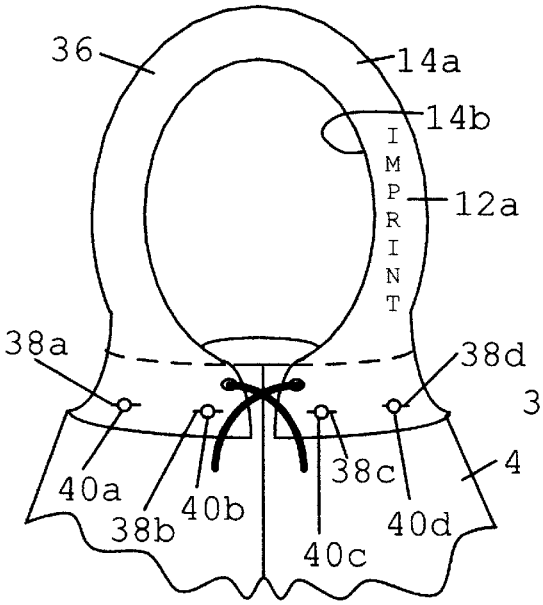
FIG. 6D is a view of the hood section attached to the collar of the chief body component.
Figure 6E:
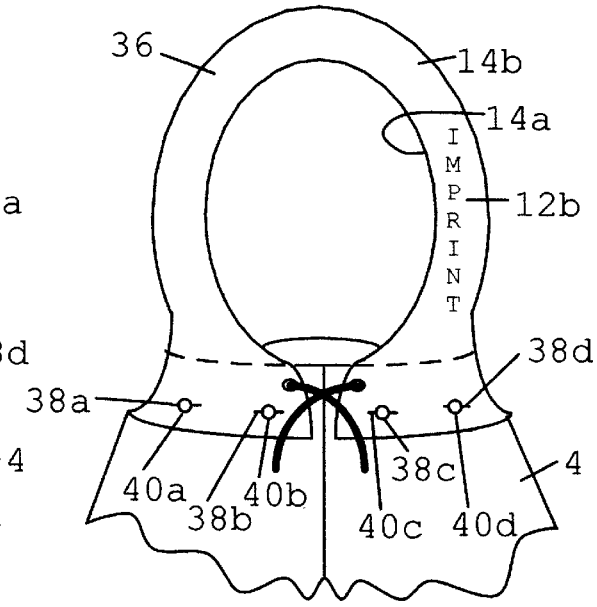
FIG. 6E is a view of FIG. 6D, reversed.
Figure 6C:
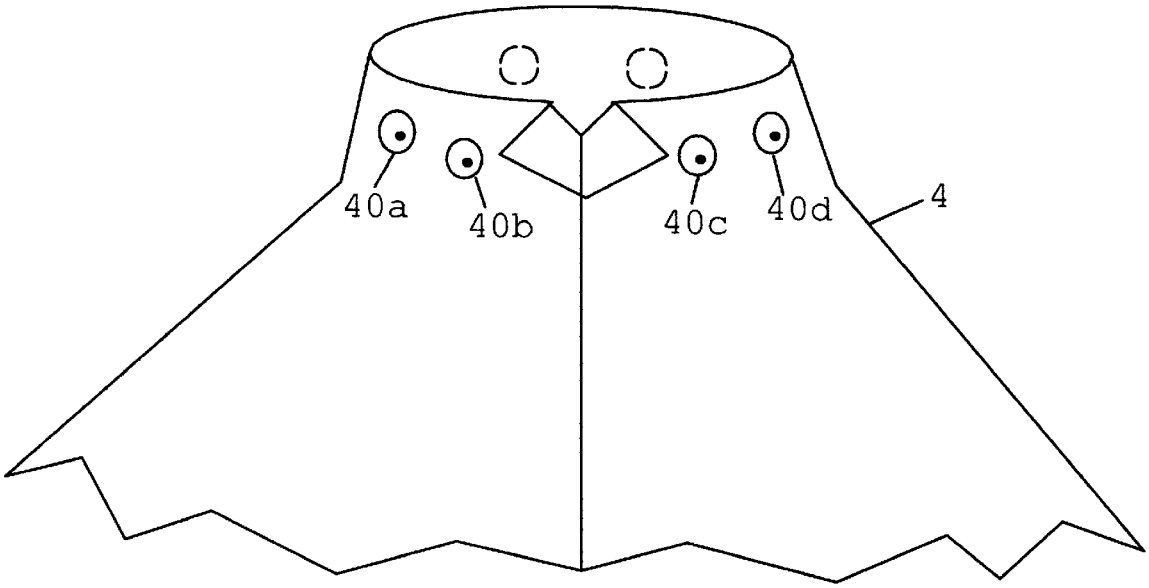
FIG. 6C is a fragmentary view of the chief body component collar with spaced buttons.

FIG. 6A show the interchangeable and reversible hood section 36 bearing colors and imprint 12*a*. The hood section 36, is carrying spaced button holes 38*a*–38*j*, near the borderlines. The spaced button holes 38*a*–38*j* are for affixing the hood section 36 onto the neck collar of the chief body component 4, which is furnished with buttons 40*a*–40*j*, that are spaced as seen in FIG. 6C.

Figure 6F:
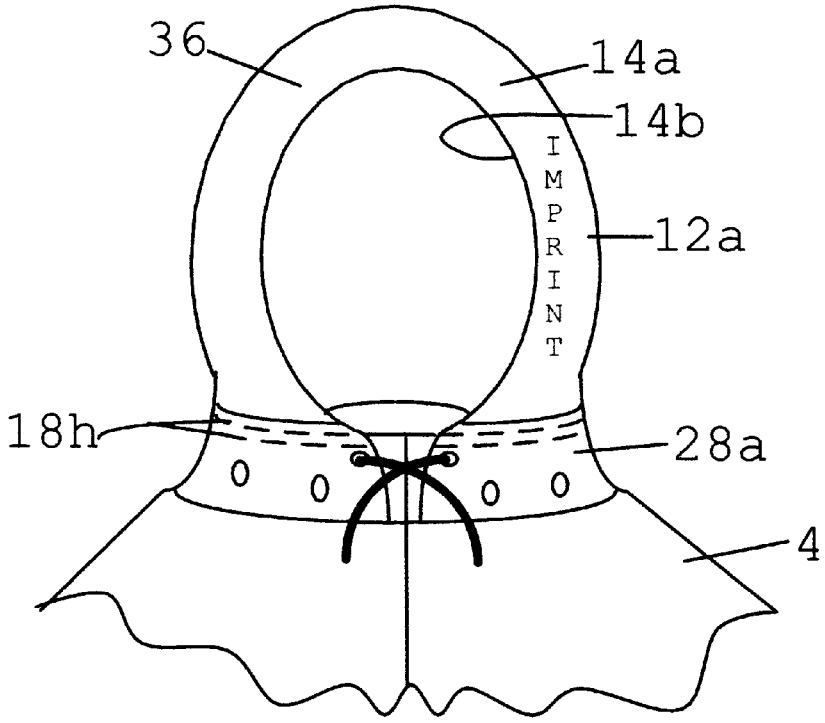
FIG. 6F is a view of a flap.
Figure 6G:
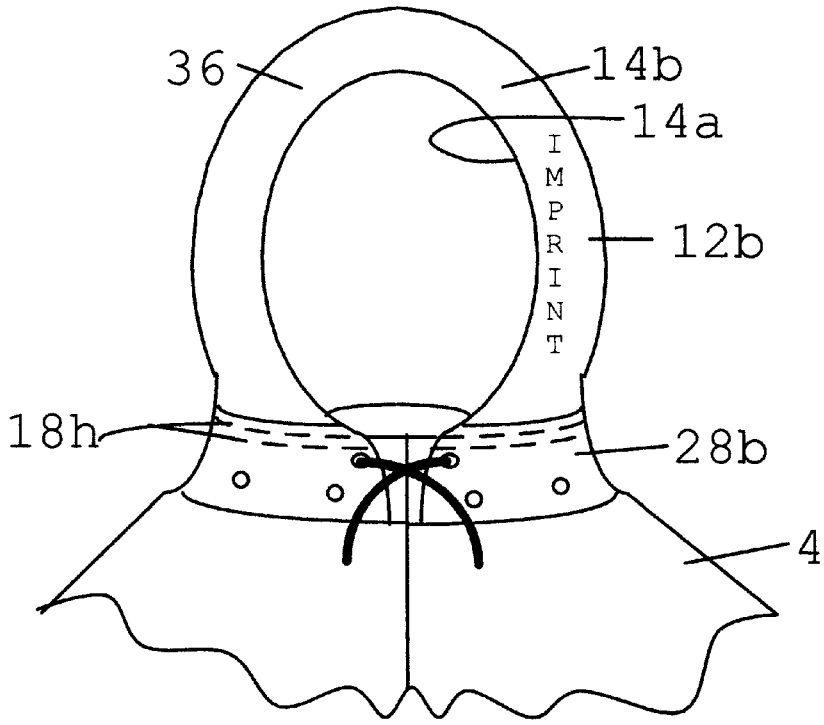
FIG. 6G is a view of FIG. 6F, reversed.

The flaps, 28*a* and 28*b*, as shown in FIGS. 6F and 6G, are added by setting and affixing them in place by double stitching 18*h*, on a suitable location near the borders of both the exterior and interior materials portions of 14*a* and 14*b* of the hood section 36. The outer flap 28*a* for instance hides the spaced buttons 40*a*–40*j*, and button holes 38*a*–38*j*, as in FIG. 6F. The inner flap 28*b* is utilized to also hide the spaced buttons 40*a*–40*j*, and button holes 38*a*–38*j*, when the hood section 36 is reversed as in FIG. 6G.

In order to reverse the hood section 36, simply turn it inside out. When the hood section 36 is reversed, flap 28*b*, and imprint 12*b* are displayed as illustrated in FIGS. 6B, 6E and 6G. Flap 28*a*, and imprint 12*a*, are displayed, when the hood section 36 is again reversed, as in FIGS. 6A, 6D and 6F.

Attaching the hood section 36 is easily executed, by pulling up flap 28*a* or 28*b*. Afterwards, insert buttons 40*a*–40*j* into button holes 38*a*–38*j*, that are positioned around the collar of the chief body component 4, as seen in FIGS. 6D and 6E.

Figure 7A:
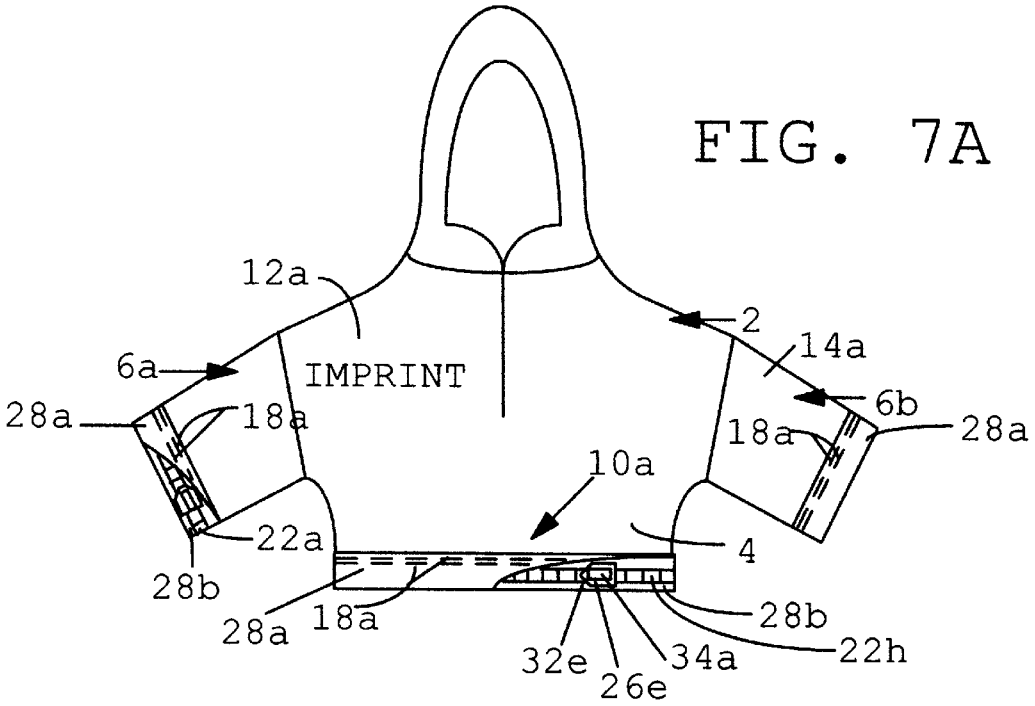
FIG. 7A is a front view of an article of apparel of the invention, in the form of a jacket, showing how the chief body component is interchangeable and reversible.
Figure 7B:
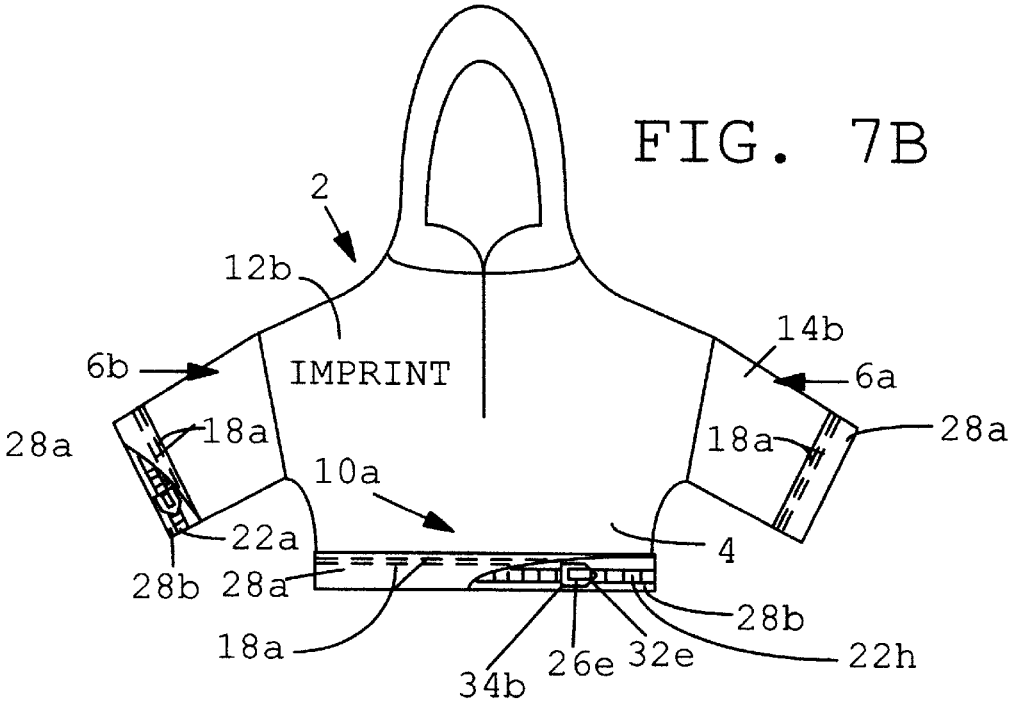
FIG. 7B is a view of FIG. 7A, reversed.
Figure 8A:
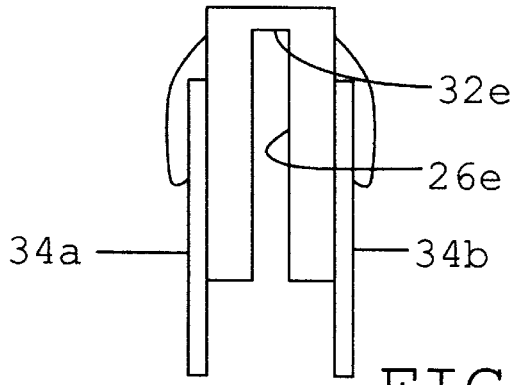
FIG. 8A illustrate a side view of a reversible slide fastening member for two side use of FIGS. 7A and 7B.
Figure 8B:
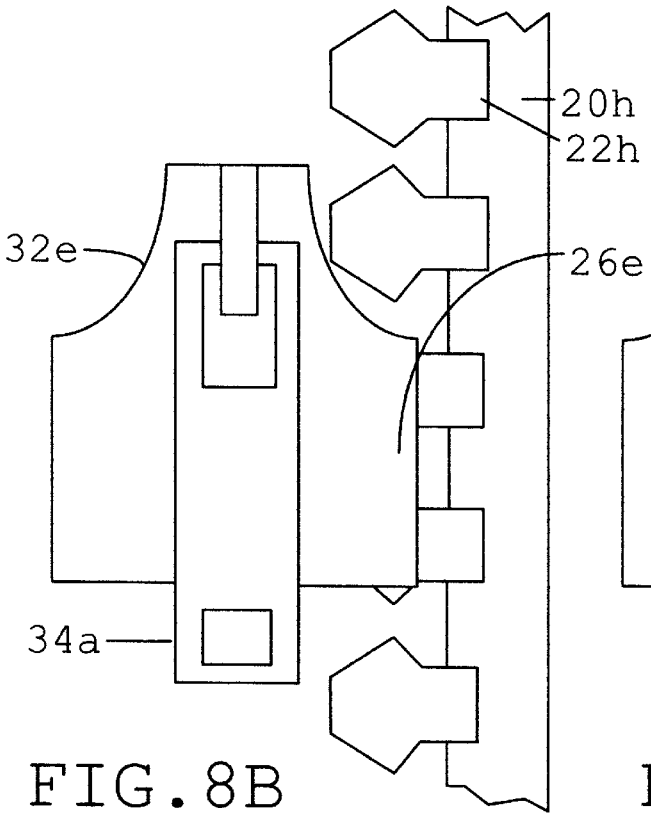
FIG. 8B illustrate a front view of FIG. 8A.
Figure 8C:
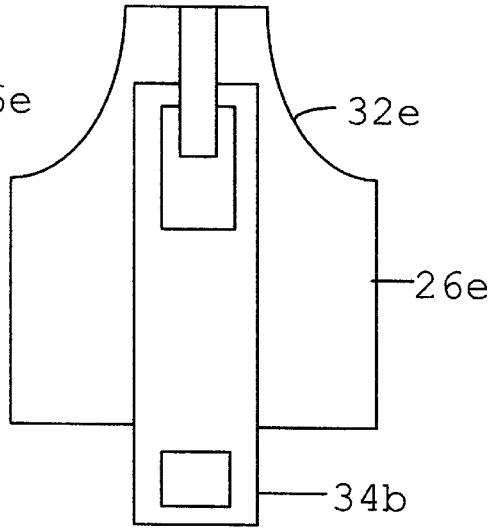
FIG. 8C illustrate a back view of FIG. 8A.

According to yet another noteworthy further development of the invention shown in FIGS. 7A and 7B, as an additional function of the chief body component 4, it possesses the capability of being interchangeable and reversible. This is permissible by outfitting the chief body component 4 with a separating zipper having tape members 20*h* and 20*i* (not shown), with symmetrical tooth members 22*h*, and a female receiving member 32*e* on a reversible slide fastening member 26*e* as shown in FIGS. 8A, 8B and 8C. Zipper tape member 20*h* is interposed between the creased materials 14*a* and 14*b* at their borderline portions on the partial upper sleeve sections 6*a* and 6*b*, and the partial upper waist section 10*a*, afterwards, is affixed with double stitching 18*h*. Zipper tape member 20*h* possess a specific set of unbroken line, of fastening tooth members 22*h*, and a female receiving member 32*e* on a reversible slide fastening member 26*e*, carrying two tabs 34*a* and 34*b* as seen in FIGS. 8A, 8B and 8C, for the purpose of two-sided usage. The material of the chief body component 4 carries various colors and imprints 12*a* and 12*b* on the outside and inside, respectively. Imprint 12*b* is displayed simply by reversing the chief body component 4 by turning it inside out. Imprint 12*a* is displayed by following the above procedure.

The reversible slide fastening member 26*e* is preferably used in this feature of the invention so that the partial lower sleeve sections 8*a* and 8*b*, and partial lower waist section 10*b*, is easily affixed and detached either from the inside or outside of the chief body component 4, when the chief body component 4 is reversed. As for an example, when the chief body component 4 is reversed, the slide fastening member 26*e* carrying two tab members 34*a* and 34*b* is pulled onward for its full length of proceeding around the fastening members 22*h* and 22*i* (not shown), either from the inside or outside of the said component 4, connecting the fastening tooth members 22*h* and 22*i* (not shown), to one another and at the same time affixing the partial interchangeable and reversible lower sleeve sections 8*a* and 8*b*, and waist section 10*a* bearing colors and imprints 12*a* and 12*b* onto both the partial upper sleeve sections 6*a* and 6*b*, and waist section 10*a*. The overall effect of this added feature is the ability to display imprints 12*b* on the inside of the chief body component 4 to a view as well.

The fastening means mention earlier in FIGS. 2A–2L are not necessarily required in this added feature. The other fastening means mentioned earlier in FIGS. 2A–2L were used on the interchangeable and reversible sections 8*a*, 8*b* and 10*a* because the chief body component 4 as illustrated and taught therein is not reversible.

Figure 7C:
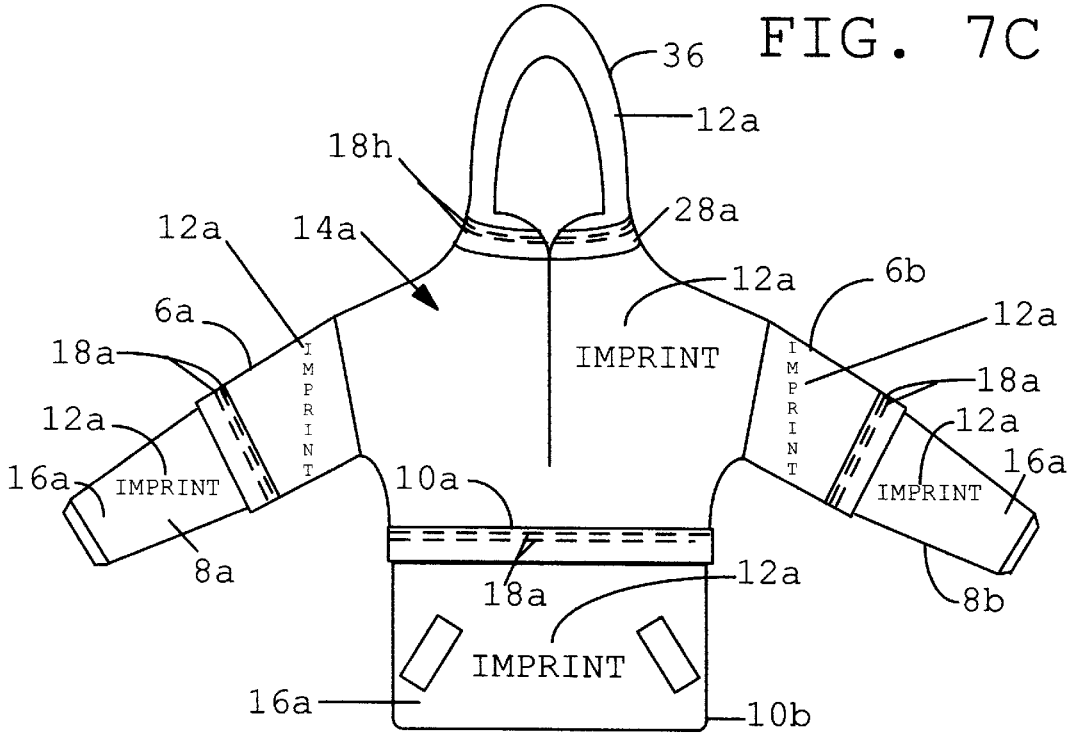
FIG. 7C illustrate the correlation and conjunction of interchangeable and reversible sections.
Figure 7D:
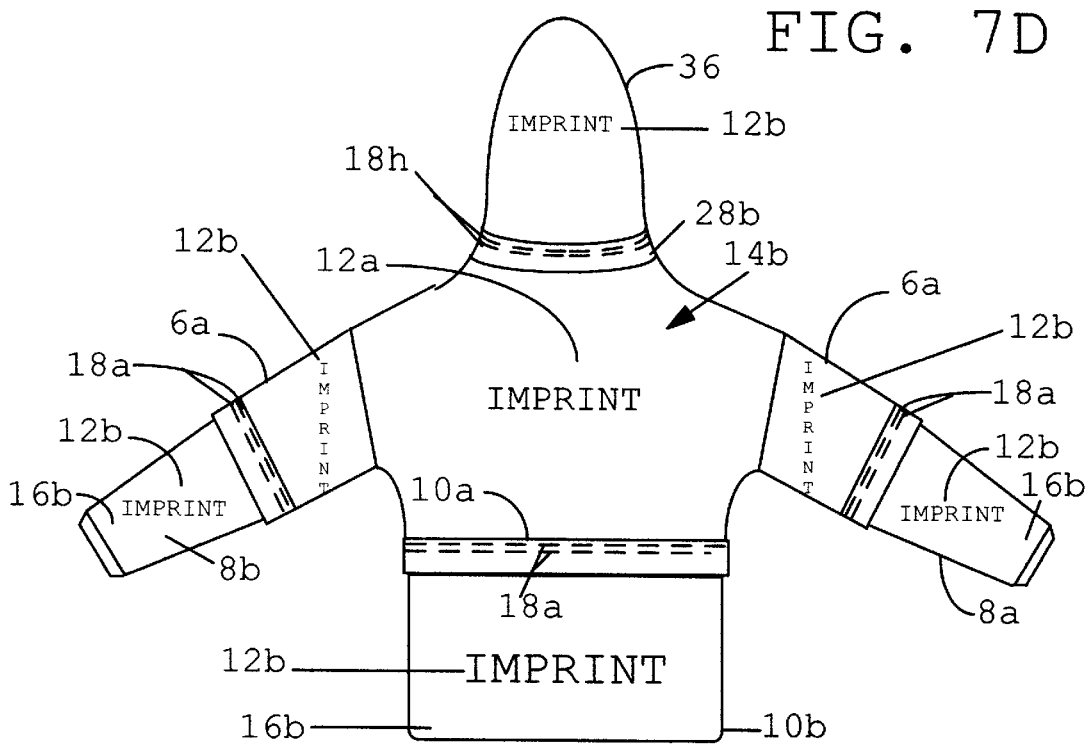
FIG. 7D is a view of FIG. 7C, reversed.

FIGS. 7C and 7D, depicts one facet of the correlation of the interchangeable and reversible chief body component 4, having the partial upper sleeve sections 6*a* and 6*b*, and partial upper waist section 10*a*, in conjunction with both the interchangeable and reversible partial lower sleeve sections, 8*a* and 8*b*, lower waist section 10*b* and hood section 36. As for an example, the outside material 14*a* of the interchangeable and reversible chief body component 4 can carry a particular imprinted basketball league logo 12*a* on the front and back section and on the sides of the partial upper sleeve sections 6*a* and 6*b*. The interchangeable and reversible partial lower sleeve sections 8*a* and 8*b*, and the partial lower waist section 10*b*, and hood section 36, can carry all of the imprinted team logos of that particular basketball league, and they can be interchanged or reversed whenever the wearer wishes to do so. When the chief body component 4 is reversed, the inside material 14*b* of the front and back sections and the side partial upper sleeve sections 6*a* and 6*b*, and hood section 36, can display a particular imprinted football league logo 12*b*, as shown in FIG. 7D. The interchangeable and reversible partial lower sleeve sections 8*a* and 8*b*, and the partial lower waist section 10*b*, and hood section 36, can each carry all of the imprinted team logos 12*b* of that particular football league, and they can be interchanged or reversed whenever the wearer wishes to do so.

Figure 9A:
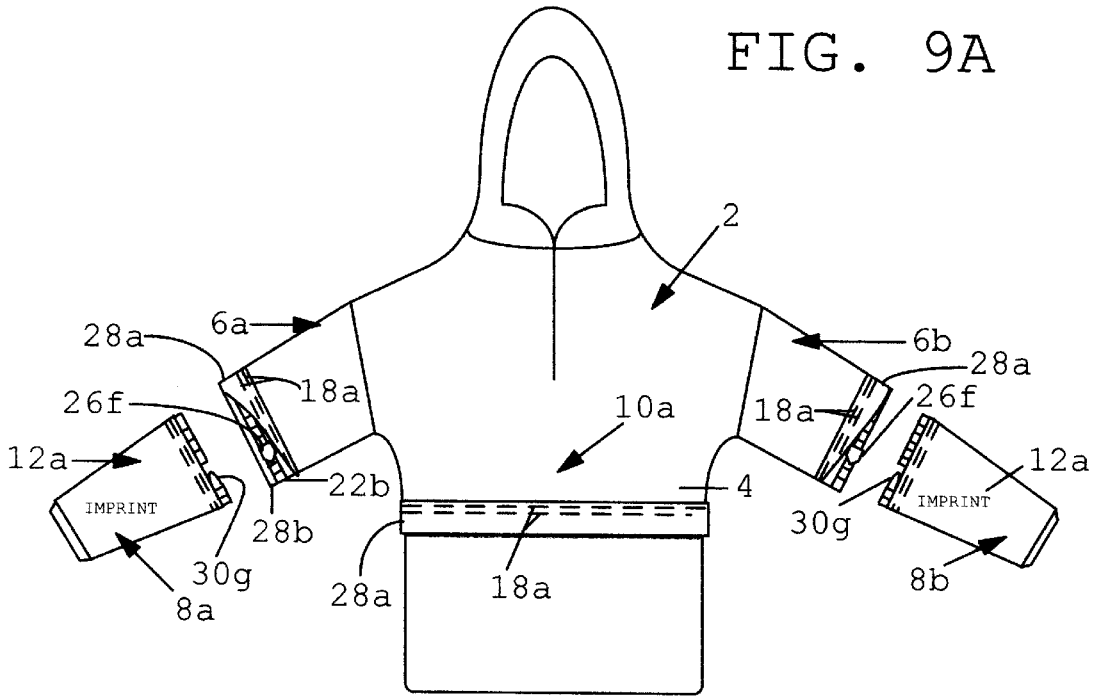
FIG. 9A shows a way of attaching a reversed sleeve section carrying a zipper with non-symmetrical tooth members.
Figure 9B:
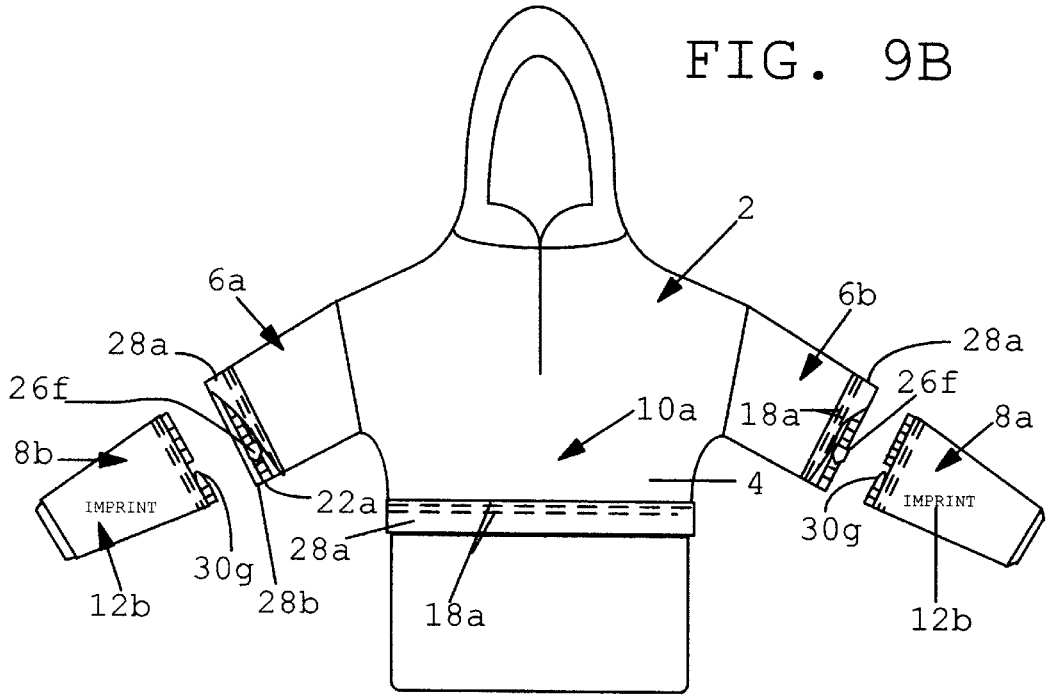
FIG. 9B is view of FIG. 9A, reversed.

When in the case of using zipper tapes with non-symmetrical tooth members in the construction of present invention their arose a problem in how to attach a reversed partial lower sleeve sections 8*a* and 8*b* onto the partial upper sleeve sections 6*a* and 6*b* of the chief body component 4 (FIGS. 9A and 9B). As for an example, when the partial lower sleeve sections 8*a* and 8*b* is detached, and then reversed so that imprint 12*b* is showing, the male inserting member 30*g* of zipper tape member 20*k* is now in the wrong position to work with the slide fastening member 26*f* of zipper tape member 20*j*. Since the male inserting member 30*g* is in the wrong position to work with the slide fastening member 26*f*, the solution is to switch the two reversed sleeve sections 8*a* and 8*b*. Partial lower sleeve 8*a* is attached to partial upper sleeve section 6*b*, and partial lower sleeve section 8*b* to partial upper sleeve section 6*a*, as shown in FIG. 9B.

Figure 10:
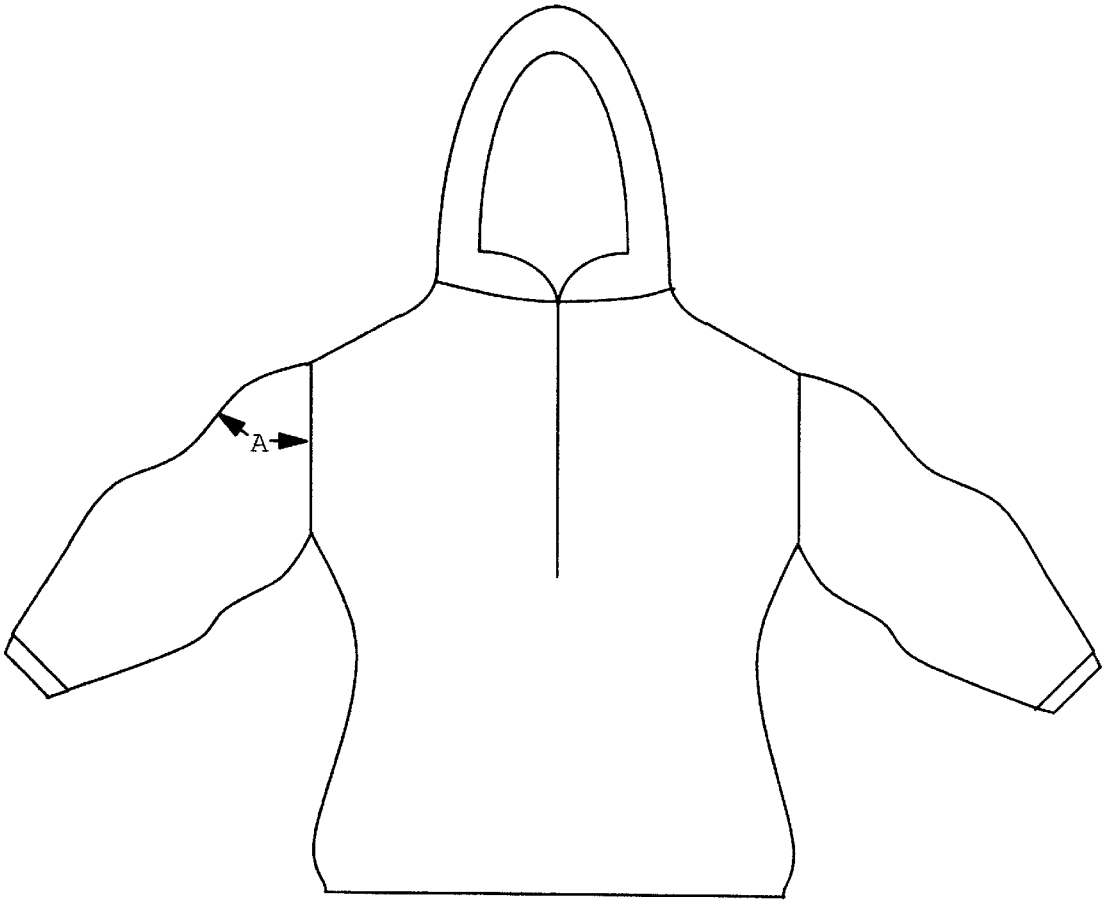
FIG. 10 illustrate a view of an inclined junction interchangeable and reversible sleeve section.

It is preferred to have a junction that is perpendicular to the sleeve. But it is also possible to include an inclined junction to be interchangeable and reversible too. The inclined is "angle A less then 90 degrees", as shown in FIG. 10.

Another modification of the present invention is; instead of interposing zipper tapes between the creased borderline materials 14*a*, 14*b*, 16*a* and 16*b* of both the partial upper and lower sleeve sections 6*a* and 8*a*, and partial upper and lower waist sections 10*a* and 10*b*, they can be interposed between two fabric bands 42*a* and 42*b*. The fabric bands 42*a* and 42*b*, with the zippers tapes being interposed between them is to be placed on the inside of borderline portions of the hole openings 24*a* and 24*b*, afterwards, stitched with double stitching 18*h*, as seen in FIG. 11.

The article shown and described was used to show the designs and constructions of the present invention. It is to be understood that invention is not to be limited to that particular article (pullover winter-type jacket). Any articles of apparel having sleeve sections and a hood section, or any pullover-type articles of apparel having sleeve sections, a waist section and a hood section can be used.

Further, it is also apparent that alterations and modifications therein may be made by those in the art to which it relates without departing from the spirit and scope of the present invention. Additionally, any type of fastening means could be implemented to affix the interchangeable and reversible sections to article's chief body component sections, such as snaps, adhesives, buttons and the like. Finally, the scope of this present invention is to be limited only by the appended claims and equivalents permitted by the laws of patents.

What is claimed is:

1. An article of clothing having a tubular section which is detached, reversed or turned inside out, and then re-attached at a tubular junction, the detach-, re-attachability being provided by a zipper which makes the detach-, re-attachability possible, said zipper having only two zipper tapes.

2. An article as claimed in claim 1, the section having imprints on both its inside and its outside, the imprints being chosen from the group consisting of sports team logos, pictures of people, and slogans.

3. An article as claimed in claim 1, the section comprising an arm section or a waist section.

4. An article as claimed in claim 1, including a zipper comprising a receiver tape having male members at both ends.

5. An article as claimed in claim 1, the zipper comprising a slider tape having symmetrical tooth members and two oppositely directed sliders.

6. An article as claimed in claim 5, the zipper further comprising a receiver tape having symmetrical tooth members and a male member at one end.

7. An article as claimed in claim 6, the receiver tape having a stop at the other end.

8. An article as claimed in claim 1, having two such sections, the sections being sleeve sections on opposite sides of the article, the zipper having non-symmetrical tooth members, re-attachability after reversing being achievable by switching the sleeve sections.

9. An article as claimed in claim 1, the section having imprints on both an inside and an outside, the imprints identifying sports teams, the imprint on the inside identifying a different team than the imprint on the outside.

10. A zipper comprising:

a slider tape having two oppositely directed sliders, and a receiver tape having a male member at one end, each tape having symmetrical tooth members.

11. A zipper as claimed in claim 10, the receiver tape having a stop at the other end.

12. An article of clothing having a section which is detached, reversed or turned inside out, and then re-attached, the section being an arm section.

13. An article of clothing having a section which is detached, reversed or turned inside out, and then re-attached, the section being a hood section, the detach-, re-attachability being provided by button holes on the hood section.

14. An article of clothing having a tubular section which is detached, reversed or turned inside out, and then re-attached at a tubular junction, the section having imprints on both an inside and an outside, the imprints identifying sports teams, the imprint on the inside identifying a different team than the imprint on the outside.

* * * * *